US008998358B2

(12) United States Patent
Ito et al.

(10) Patent No.: US 8,998,358 B2
(45) Date of Patent: Apr. 7, 2015

(54) LIQUID CARTRIDGE, LIQUID EJECTING DEVICE COMPRISING LIQUID CARTRIDGE AND MAIN BODY, METHOD OF MANUFACTURING LIQUID CARTRIDGE, AND METHOD OF REFURBISHING LIQUID CARTRIDGE

(75) Inventors: Noritsugu Ito, Tokoname (JP); Mikio Hirano, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 293 days.

(21) Appl. No.: 13/192,234

(22) Filed: Jul. 27, 2011

(65) Prior Publication Data

US 2012/0069068 A1 Mar. 22, 2012

(30) Foreign Application Priority Data

Aug. 31, 2010 (JP) ..... 2010-195173

(51) Int. Cl.
*B41J 2/195* (2006.01)
*B41J 2/175* (2006.01)

(52) U.S. Cl.
CPC ..... *B41J 2/17559* (2013.01); *B41J 2/17506* (2013.01); *B41J 2/17523* (2013.01); *B41J 2/17546* (2013.01); *B41J 2/17553* (2013.01); *B41J 2/17596* (2013.01)

(58) Field of Classification Search
USPC ..... 347/7, 86, 19, 85, 5, 84
See application file for complete search history.

(56) References Cited

U.S. PATENT DOCUMENTS 6,213,597 B1 * 4/2001 Liu ..... 347/85
2004/0217995 A1 * 11/2004 Matsushita et al. ..... 347/7
2005/0243148 A1 11/2005 Miyazawa et al.
2007/0040859 A1 * 2/2007 Kimura ..... 347/7
2008/0012886 A1 * 1/2008 Oomura ..... 347/7
2008/0316251 A1 12/2008 Heo (Continued)

FOREIGN PATENT DOCUMENTS

EP 1555128 A1 7/2005
JP H08-080618 A 3/1996
JP 2002-178535 A 6/2002
JP 2010-069807 A 4/2010
JP 2010-082881 A 4/2010
JP 2011-148203 A 8/2011

OTHER PUBLICATIONS

European Patent Office, extended European Search Report for European Patent Application No. 11175650.8 (counterpart European patent application), dated Jul. 11, 2012.
International Searching Authority, International Search Report and Written Opinion for International Application No. PCT/JP2011/067823 (counterpart PCT application), mailed Oct. 4, 2011.
State Intellectual Property Office of the People's Republic of China, Notification of First Office Action for Chinese Patent Application No. 201110220955.4, mailed Dec. 16, 2013.
State Intellectual Property Office of the People's Republic of China, Notification of Second Office Action for Chinese Patent Application No. 201110220955.4, mailed Aug. 26, 2014.

*Primary Examiner* — Lam S Nguyen
(74) *Attorney, Agent, or Firm* — Baker Botts L.L.P.

(57) ABSTRACT

A liquid cartridge includes a liquid storing portion that stores liquid therein, a liquid path that is in fluid communication with the liquid storing portion, a sensor, and a memory. The sensor outputs a particular data corresponding to a particular value indicating that the liquid storing portion is in fluid communication with an exterior of the liquid cartridge, and a further data corresponding to a further value indicating that the liquid storing portion is not in fluid communication with the exterior of the liquid cartridge. The memory includes a first data corresponding to a first value and a second data corresponding to a second value. The first value and the second value are defined such that when the particular data and the further data are outputted, one half of a sum of the first value and the second value is between the particular value and the further value.

24 Claims, 26 Drawing Sheets

(56) References Cited

U.S. PATENT DOCUMENTS

| | | | |
|---|---|---|---|
| 2009/0153602 | A1 | 6/2009 | Brown et al. |
| 2009/0322838 | A1 | 12/2009 | Wanibe et al. |
| 2011/0228019 | A1 | 9/2011 | Ito et al. |
| 2011/0242232 | A1 | 10/2011 | Ito et al. |
| 2011/0242233 | A1 | 10/2011 | Hirano et al. |
| 2012/0075392 | A1 | 3/2012 | Shirono et al. |
| 2013/0027480 | A1 | 1/2013 | Otobe |

* cited by examiner

LIQUID CARTRIDGE, LIQUID EJECTING DEVICE COMPRISING LIQUID CARTRIDGE AND MAIN BODY, METHOD OF MANUFACTURING LIQUID CARTRIDGE, AND METHOD OF REFURBISHING LIQUID CARTRIDGE

CROSS REFERENCE TO RELATED APPLICATION

This application claims priority to Japanese Patent Application No. 2010-195173, filed Aug. 31, 2010, the entire subject matter and disclosure of which is incorporated herein by reference.

BACKGROUND OF THE INVENTION

1. Field of the Invention

The invention relates to a liquid cartridge configured to store liquid, e.g., ink, a liquid ejecting device comprising a main unit and a liquid cartridge configured to be mounted to the main unit, a method for manufacturing a liquid cartridge, and a method for refurbishing a liquid cartridge.

2. Description of Related Art

A known recording apparatus has a main unit and an ink cartridge configured to be mounted to the main unit. The recording apparatus has a sensor for the recording apparatus to determine completion of mounting of an ink cartridge to the main unit of the recording apparatus. Specifically, when the known ink cartridge is mounted to a mounting portion of the main unit of the known recording apparatus, a pair of resistors provided on a surface of the ink cartridge comes into contact with a pair of electrodes provided at the mounting portion, respectively, whereby the pair of electrodes is electrically connected to each other via the pair of resistors, which enables the determination that the ink cartridge is mounted in the mounting portion.

However, although the mounting of the ink cartridge to the mounting portion can be determined by the detection of the electric connection between the electrodes, it is not determined whether a hollow tube of the main unit has been inserted into an ink outlet path of the ink cartridge completely. Accordingly, the known ink cartridge does not determine whether an ink path extending from the ink cartridge to the main unit has been formed.

SUMMARY OF THE INVENTION

Therefore, a need has arisen for a liquid cartridge which overcomes these and other shortcomings of the related art. A technical advantage of the present invention is that it is possible to determine whether a hollow tube of a main unit has been inserted into a liquid outlet path of a liquid cartridge to form a liquid supply path.

In an aspect of the invention, a liquid cartridge comprises a liquid storing portion configured to store liquid therein, a liquid path configured to be in fluid communication with the liquid storing portion, a sensor configured to output a particular data corresponding to a particular value indicating that the liquid storing portion is in fluid communication with an exterior of the liquid cartridge, and a further data corresponding to a further value indicating that the liquid storing portion is not in fluid communication with the exterior of the liquid cartridge, and a memory comprising a first data corresponding to a first value and a second data corresponding to a second value, wherein the first value and the second value are defined such that when the particular data and the further data are outputted, one half of a sum of the first value and the second value is between the particular value and the further value.

In another aspect of the invention, a liquid cartridge comprises a liquid storing portion configured to store liquid therein, a liquid path configured to be in fluid communication with the liquid storing portion, a sensor configured to output a particular data corresponding to a particular value when the liquid storing portion is in fluid communication with an exterior of the liquid cartridge, and a further data corresponding to a further value when the liquid storing portion is not in fluid communication with the exterior of the liquid cartridge, and a memory configured to store at least one of the particular data corresponding to the particular value and the further data corresponding to the further value.

In another aspect of the invention, a liquid cartridge comprises a liquid storing portion configured to store liquid therein, a liquid path configured to be in fluid communication with the liquid storing portion, a sensor configured to output a data corresponding to a plurality of values related to a presence or an absence of an object other than the liquid in a predetermined position in the liquid path, a memory configured to store at least one of a particular data corresponding to a particular value of the plurality of values that corresponds to the presence of the object in the predetermined position in the liquid path and a further data corresponding to a further value of the plurality of values that corresponds to the absence of the object in the predetermined position of the liquid path.

In another aspect of the invention, a liquid cartridge comprises a liquid storing portion configured to store liquid therein, a sensor having a characteristic such that an output of the sensor is configured to change based on a state of the liquid cartridge, and a memory configured to store a particular value related to the characteristic.

In another aspect of the invention, a liquid ejecting device comprises a liquid cartridge and a main body, wherein the liquid cartridge is removably attachable to the main body. The liquid cartridge comprises a liquid storing portion configured to store liquid therein, a liquid path configured to be in fluid communication with the liquid storing portion, a sensor configured to output a particular data corresponding to a particular value indicating that the liquid storing portion is in fluid communication with an exterior of the liquid cartridge, and a further data corresponding to a further value indicating that the liquid storing portion is not in fluid communication with the exterior of the liquid cartridge, and a memory comprising a first data corresponding to a first value and a second data corresponding to a second value, wherein the first value and the second value are defined such that when the particular data and the further data are outputted, one half of a sum of the first value and the second value is between the particular value and the further value. The main body comprises a mounting portion to which the liquid cartridge is selectively receivable, an insertion member configured to be removably insertable into the liquid cartridge, and a controller configured to retrieve the first data corresponding to the first value, and second data corresponding to the second value, wherein when the insertion member is inserted into the liquid cartridge, the controller is configured to retrieve the data corresponding to the particular value and to determine whether the particular value is less than or equal to one half of a sum of the first value and second value.

In another aspect of the invention, a method of manufacturing a liquid cartridge having a liquid path attached to a liquid storing portion, comprises storing a first data corresponding to a first value in a memory, storing a second data corresponding to a second value in the memory, disposing a sensor near the liquid path, wherein the sensor is configured to output a particular data corresponding to a particular value indicating that the liquid storing portion is in fluid communication with an exterior of the liquid cartridge, and a further data corresponding to a further value indicating that the liquid storing portion is not in fluid communication with the exterior of the liquid cartridge, wherein one half of a sum of the first value and the second value is between the particular value and the further value, filling the liquid storing portion with liquid, and plugging the liquid path by disposing a plug in the liquid path.

In another aspect of the invention, a method of refurbishing a liquid cartridge having a liquid path attached to a liquid storing portion, a sensor disposed near the liquid path, and a memory comprising a first data corresponding to a first value and a second data corresponding to a second value comprises preparing the liquid cartridge for refilling, storing a new first data corresponding to a new first value in the memory to replace the first data, storing a new second data corresponding to a new second value in the memory to replace the second data, wherein the sensor is configured to output a particular data corresponding to a particular value indicating that the liquid storing portion is in fluid communication with an exterior of the liquid cartridge, and a further data corresponding to a further value indicating that the liquid storing portion is not in fluid communication with the exterior of the liquid cartridge, wherein one half of a sum of the new first value and the new second value is between the particular value and the further value, refilling the liquid storing portion with liquid, and plugging the liquid path by disposing a plug in the liquid path.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the invention and their features and technical advantages may be understood by referring to FIGS. 1-23B, like numerals being used for like corresponding parts in the various drawings.

Figure 1:
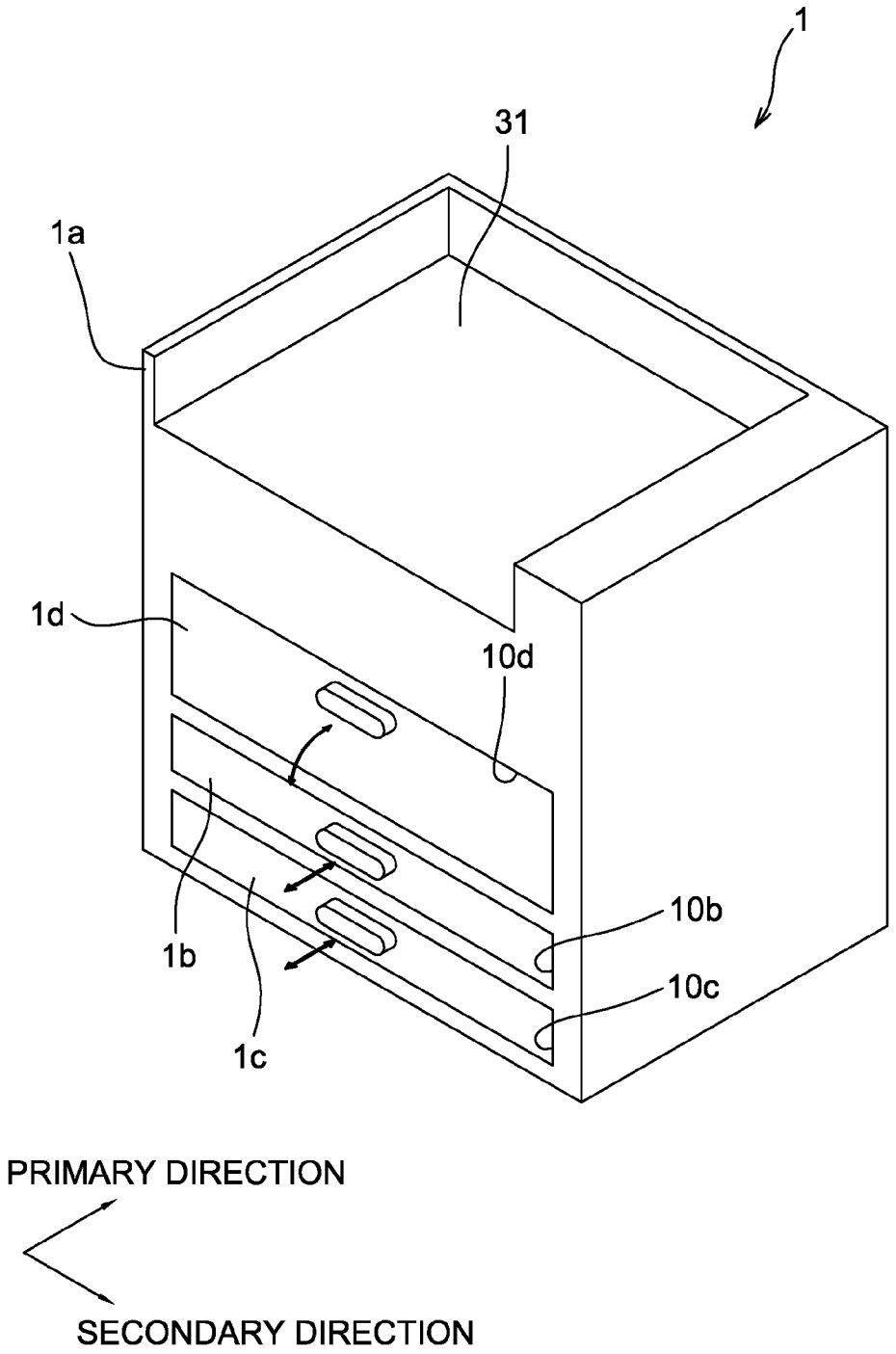
FIG. 1 is a perspective view of a liquid ejecting device, e.g., an ink jet printer, according to an embodiment of the invention.
Figure 2:
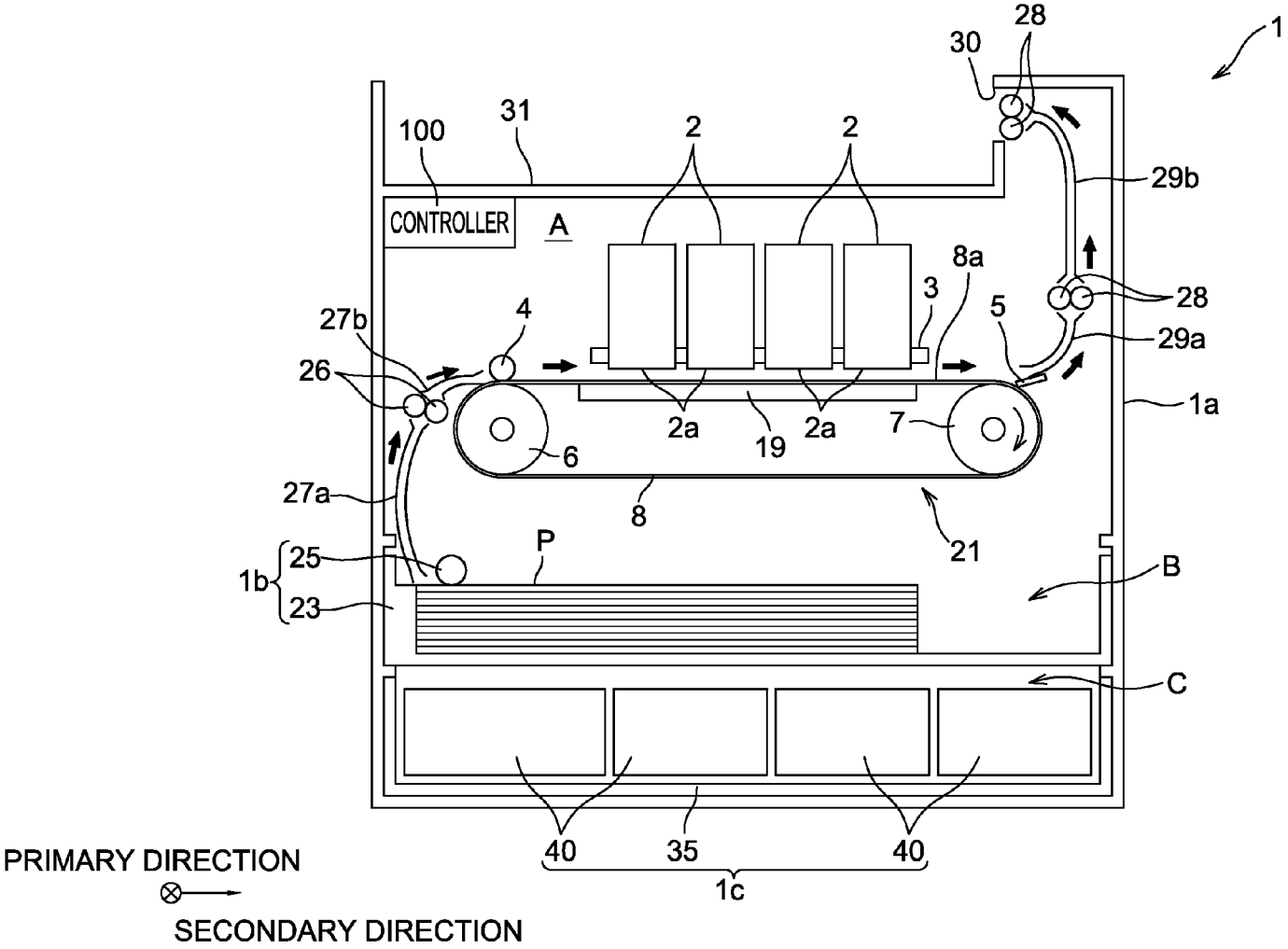
FIG. 2 is schematic side view showing an internal structure of the ink jet printer, according to an embodiment of the invention.

FIG. 1 describes a general structure of a liquid ejecting device, e.g., an ink jet printer 1, according to an embodiment of the invention. The printer 1 may comprise a main unit and one or more fluid cartridges 40 configured to be mounted to the main unit. The main unit of the ink jet printer 1 may comprise a housing 1*a* having substantially a rectangular parallelepiped shape. A sheet discharge portion 31 may be disposed at the top of the housing 1*a*. The housing 1*a* may have three openings 10*d*, 10*b*, and 10*c* formed in one of its vertically extending outer faces, e.g., a front face of the printer 1. The openings 10*d*, 10*b*, and 10*c* may be vertically aligned in this order from higher to lower when the printer 1 is oriented vertically as shown in FIG. 1. A sheet feed unit 1*b* and an ink unit 1*c* may be removably inserted into the housing 1*a* though the openings 10*b* and 10*c*, respectively. The printer 1 may comprise a door 1*d* fitted into the opening 10*d* and configured to pivot about a horizontal axis at a lower end of door 1*d*. When the door is pivoted to be opened and closed, the opening 10*d* is covered and uncovered, respectively. As shown in FIG. 2, the door 1*d* may be disposed with an interior surface facing a transporting unit 21 interior to the printer 1 in a primary direction.

FIG. 2 shows a general internal structure of the printer 1. The interior of the housing 1*a* may be divided into spaces A, B, and C in the vertical direction in this order from above to below, as shown in FIG. 2. A plurality of, e.g., four, ink jet heads 2, the transporting unit 21, and a controller 100 may be disposed within the space A. The four ink jet heads 2 may be configured to discharge inks of magenta, cyan, yellow, and black, respectively, although in other embodiments, the ink jet heads 2 may be configured to eject other color inks, or other types of liquids, e.g., water, or. The transporting unit 21 may be configured to transport sheets P. The controller 100 may be configured to control operations of the components of the printer 1. The sheet feed unit 1*b* may be disposed in the space B, and the ink unit 1*c* may be disposed in the space C. A sheet transport path, along which sheets P may be transported, may be formed in the housing 1*a*. The sheet transport path may extend from the sheet feed unit 1*b* toward the sheet discharge portion 31, as shown by the bold arrows in FIG. 2.

Figure 4:
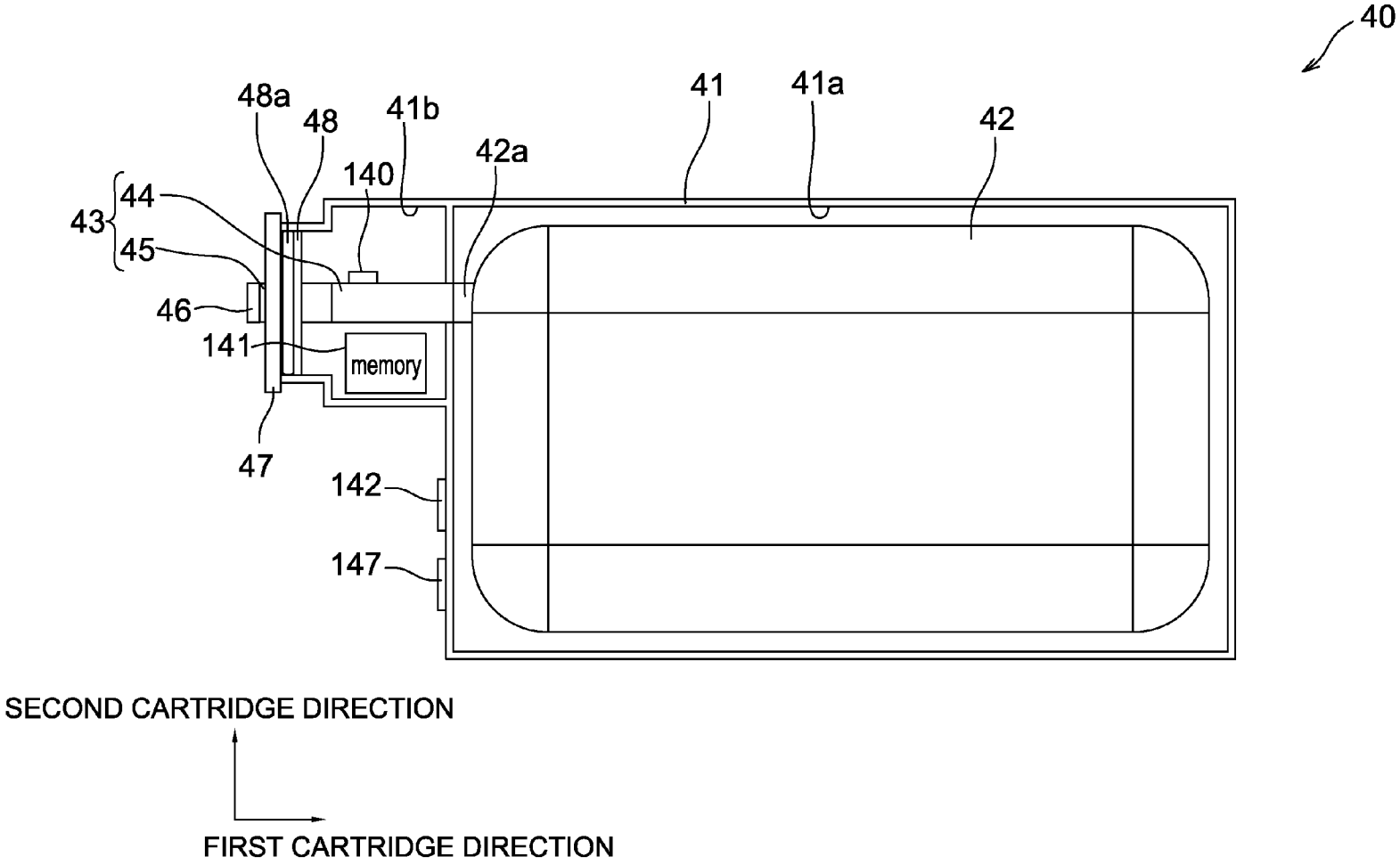
FIG. 4 is a schematic view showing an internal structure of the ink cartridge, according to an embodiment of the invention.

The controller 100 may comprise a central processing unit (CPU), a read only memory (ROM), a random access memory (RAM) such as a nonvolatile RAM, and an interface. The ROM may store programs to be executed by the CPU, and various fixed data. The fixed data may comprise a printer ID, which may be assigned to the printer as its unique label. The printer can be distinguished from other printers by reading its printer ID. In an embodiment of the invention, the printer ID may reveal other information regarding the characteristics of the printer. The RAM may temporarily store data, e.g., image data, which the CPU may use to execute programs. As shown in FIG. 4, a liquid cartridge, e.g., liquid cartridge 40, may comprise a memory 141. The controller 100 may receive data from the liquid cartridge 40, may transmit and receive data to and from a sensor 140 of the fluid cartridge 40, and may transmit and receive data to and from an external device, e.g., a personal computer connected to the printer 1.

Figure 12:
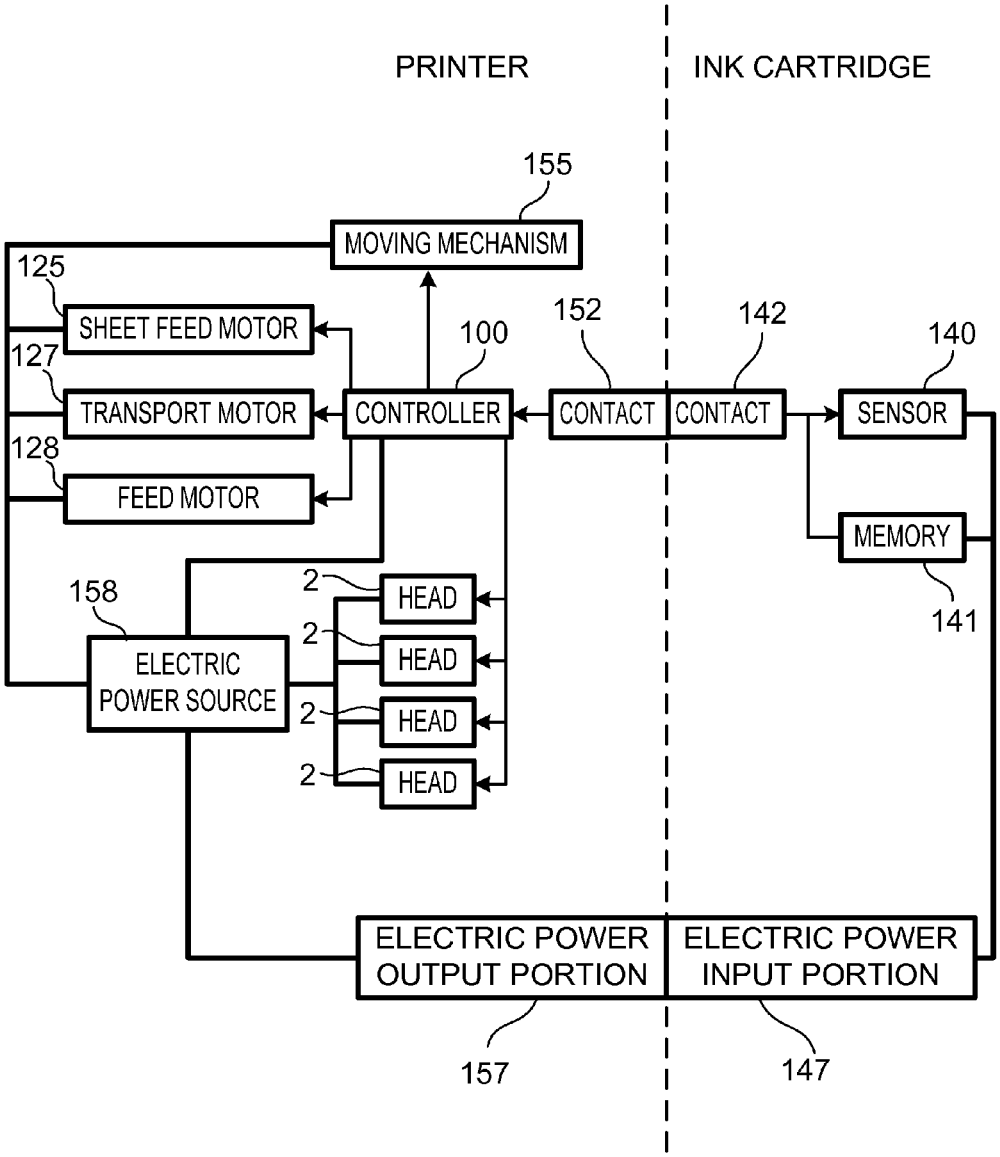
FIG. 12 is a block diagram showing an electrical configuration of the ink jet printer and the ink cartridge, according to an embodiment of the invention.

Referring again to FIG. 2, the sheet feed unit 1*b* may comprise a sheet feed tray 23 and a sheet feed roller 25. The sheet feed tray 23 may be configured to be detachably attached to the housing 1*a* in the primary direction. The sheet fed tray 23 may have a substantially box shape, open upward. Sheet feed tray 23 may be configured to store sheets P of various sizes. As shown in FIG. 12, a sheet feed motor 125 that may be controlled by the controller 100, may drive the sheet feed roller 25, which may be configured to feed out the topmost sheet P in the sheet feed tray when driven by sheet feed roller 25. The sheet P fed out by the sheet feed roller 25 may be sent to the transporting unit 21 while being guided by guides 27*a* and 27*b* and while being nipped by a pair of feed rollers 26.

The transport unit 21 may comprise two belt rollers 6 and 7, and an endless transport belt 8 may be wound around the belt rollers 6 and 7. In an embodiment of the invention, the belt roller 7 may be a driving roller configured to rotate in the clockwise direction when the printer is oriented as shown in FIG. 2. Specifically, referring to FIG. 12, when a shaft of the belt roller 7 is driven by a transport motor 127 controlled by the controller 100, the belt roller 7 may receive a driving force from the transport motor 127. Referring again to FIG. 2, The belt roller 6 may be a driven roller configured to rotate in the clockwise direction when the printer is oriented as shown in FIG. 2, along with the running of the transport belt 8 caused by the rotation of the belt roller 7.

A platen 19 having a substantially rectangular parallelepiped shape may be disposed within the loop of the transport belt 8. An outer surface 8*a* of the transport belt 8 at an upper portion of the loop may face lower surfaces 2*a* of the ink jet heads 2, and may extend substantially in parallel with the lower surfaces 2*a* with a slight gap formed between the lower surfaces 2*a* and the outer surface 8*a*. The platen 19 may support an inner surface of the transport belt 8 at the upper portion of the loop 8. The lower surface 2*a* of each ink jet head 2 may be a discharge surface where a plurality of discharge nozzles for discharging ink may be formed.

A silicone layer having a low adhesive property may be formed on the outer surface 8*a* of the transport belt 8. The sheet P that is fed out from the sheet feed unit 1*b* toward the transport unit 21 may be pressed by a pressing roller 4 against the outer surface 8*a* of the transport belt 8. While being held on the outer surface 8*a* by the adhesive property of outer surface 8*a*, the sheet P may be transported in a secondary direction as shown by the bold arrows in FIG. 2.

The secondary direction may be substantially parallel with a transporting direction in which the transporting unit 21 transports the sheet P. The primary direction is a direction substantially perpendicular to the secondary direction. As shown in FIG. 2, each of the primary direction and the secondary direction is a horizontal direction.

When the sheet P held on the outer surface 8*a* of the transport belt 8 passes immediately below the four ink jet heads 2, the ink jet heads 2 discharge inks of respective colors from the lower surfaces 2*a* sequentially, thereby forming an image, e.g., a color image, on the sheet P. A separating plate 5 is configured to separate the sheet P from the outer surface 8*a* of the transport belt 8 when the sheet P is fed to the separating plate 5. The sheet P may be transported upward while being guided by guides 29*a*, 29*b* and while being nipped by two pairs of transport rollers 28, and may be discharged through an opening 30 formed at the top of the housing 1*a* onto the sheet discharge portion 31. Referring to FIG. 12, one roller of each transport roller pair 28 may be driven by a feed motor 128 controlled by the controller 100.

Referring again to FIG. 2, the head 2 may be a line-type head that is elongated in the primary direction and has substantially a rectangular parallelepiped shape. The four heads 2 may be arranged having a predetermined pitch in the secondary direction and may be supported by the housing 1*a* via a frame 3. A joint may be disposed at an upper surface of each head 2, and may receive a flexible tube (not shown). A plurality of discharge nozzles (not shown) may be formed in the lower surface of each head 2. An ink path may be formed inside each head 2 such that ink supplied from a corresponding liquid cartridge 40, via a corresponding tube and a corresponding joint, may flow to corresponding discharge nozzles.

The ink unit 1*c* may comprise a cartridge tray 35, and a plurality of, e.g., four liquid cartridges 40 removably disposed in the liquid cartridge tray 35. The liquid cartridge 40 at the leftmost position in FIG. 2 may store black ink, and may have a greater size in the secondary direction and a greater ink capacity than the other three liquid cartridges 40. The other three liquid cartridges 40 may have substantially the same ink capacity, and may store magenta, cyan, and yellow ink, respectively. The ink stored in each liquid cartridge 40 is supplied to a corresponding head 2 via a corresponding tube (not shown) and a corresponding joint (not shown). The liquid cartridge tray 35 is detachably attached to the housing 1*a* in the primary direction in a state where the liquid cartridges 40 are disposed in the liquid cartridge tray 35. Accordingly, the liquid cartridges 40 in the liquid cartridge tray 35 may be selectively replaced in a state in which the liquid cartridge tray 35 is detached from the housing 1*a*.

Figure 3:
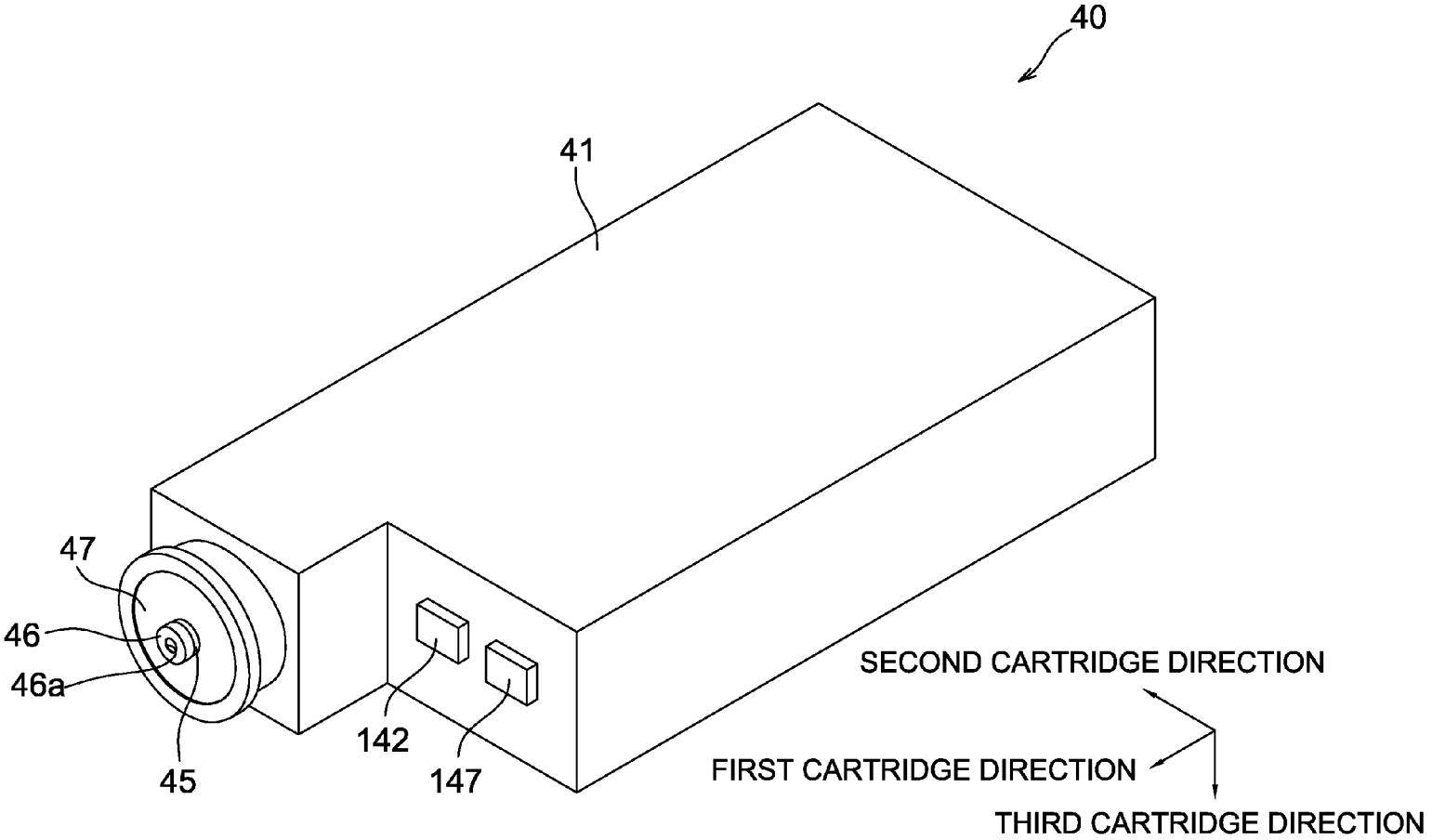
FIG. 3 is a perspective view of a liquid cartridge, e.g., an ink cartridge, according to an embodiment, which is detachably mounted to the ink jet printer.

FIGS. 3-5 illustrate a structure of the fluid cartridge 40 according to an embodiment of the invention. The four fluid cartridges 40 to be disposed in the cartridge tray 35 have the same structure except that the black ink cartridge has a greater size in the secondary direction and a greater ink capacity than the other three ink cartridges. As shown in FIGS. 3 and 4, each liquid cartridge 40 may comprise a housing 41 having substantially a rectangular parallelepiped shape, a storing portion, e.g., a reservoir 42 disposed in the housing 41 (shown in FIG. 4), an ink outlet tube 43 defining an ink outlet path 43*a* (shown in FIG. 5) for discharging the ink stored in the reservoir 42 to the outside of the liquid cartridge 40, e.g., to head 2, a first valve 50 and a movable member, e.g., a second valve 60 (shown in FIG. 5), which first valve and movable member may be disposed in the ink outlet path 43*a*, the sensor 140 (shown in FIGS. 4 and 5) for detecting the second valve 60, the memory 141, a contact 142, and an electric power input portion 147.

As shown in FIG. 3, the housing 41 has a substantially rectangular parallelepiped shape. In an embodiment of the invention, the dimension of the housing 41 in a first cartridge direction, i.e., the length, is greater than the dimension of the housing 41 in a second cartridge direction, i.e., the width, and the width dimension of the housing 41 in the second cartridge direction is greater than the dimension of the housing in a third cartridge direction, i.e., the height. The first cartridge direction, the second cartridge direction, and the third cartridge direction are each perpendicular to the other two directions. When the liquid cartridge 40 is mounted in the liquid cartridge tray 35 of the printer 1, the first cartridge dimension is aligned with the primary direction, the second cartridge direction is aligned with the secondary direction, and the third cartridge direction is aligned with the vertical direction.

Referring to FIG. 4, the interior of the housing 41 may be divided into at least two chambers 41*a* and 41*b* in the first cartridge direction. The reservoir 42 may be disposed in the first chamber, e.g., the right chamber 41*a*, and the ink outlet tube 43 may be disposed in the second chamber, e.g., the left chamber, e.g., the other chamber 41*b*. The reservoir 42 may be a collapsible bag-shaped member that stores liquid, e.g., ink, therein and which may be disposed in the housing 41. The reservoir 42 may have an opening to which one end of the ink outlet tube 43 may be connected. The ink outlet tube 43 may define a liquid path, e.g., an ink outlet path 43*a* for discharging the ink stored in the reservoir 42 to the head 2.

As shown in FIG. 4, the ink outlet tube 43 may comprise two tubes 44 and 45 extending in the first cartridge direction and connected to each other. The joint 42*a* may be fitted into one end of the tube 44, and the tube 45 may be fitted into the other end of the tube 44. The ink outlet path 43 may be formed in the tubes 44 and 45, as shown in FIG. 5. The ink outlet path 43*a* may be defined, as continuous two interiors, by the tubes 44 and 45.

As shown in FIGS. 4 and 5, a ring-shaped flange 47 and a ring-shaped protrusion 48 may be integrally formed at the other end of the tube 44. The flange 47 may be a substantially disk-shaped member extending from an outer surface of the other end of the tube 44 in radial direction of the tube 44. The ring-shaped protrusion 48 may extend from the flange 47 toward the reservoir 42 in the first cartridge direction. An O-ring 48*a* is fitted around the ring-shaped protrusion 48 and seals a gap between an inner surface of the housing 41 and the ring-shaped protrusion 48.

As shown in FIG. 5, the first valve 50 may be disposed in the tube 45 and may comprise a plug 51, a spherical member 52, and a coil spring 53. The plug 51 may comprise an elastic material, e.g., rubber, and may be disposed in a compressed state at the other end of the tube 45 such that the plug 51 may close an opening of the other end of the tube 45. The plug 51 may have a slit 51*a* formed in its center, and the slit 51*a* may extend in the first cartridge direction. The plug 51 may comprise a ring-shaped protrusion 51*b* fitted into the other end of the tube 45, and a curved portion 51*c* surrounded by the ring-shaped protrusion 51*b* and facing the spherical member 52. The curved portion 51*c* may comprise a shape such that the curved portion 51*c* follows an outer circumferential surface of the spherical member 52. The inner diameter of the ring-shaped protrusion 51*b* may be slightly less than the diameter of the spherical member 52.

Figure 5A:
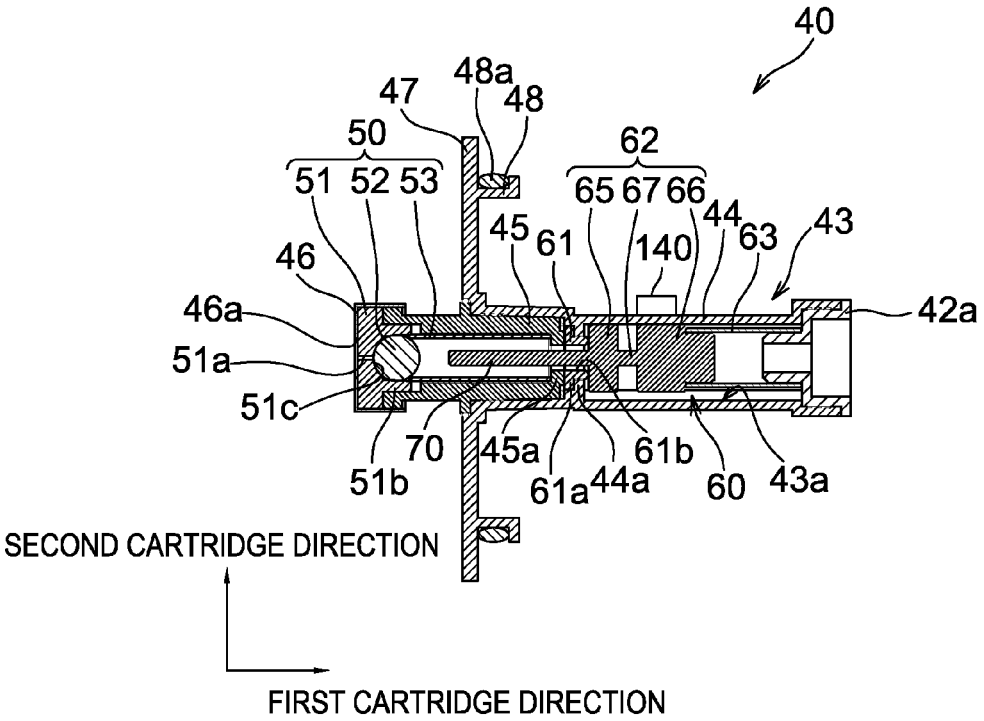
FIG. 5A is a partial cross-sectional view of the ink cartridge, in which each of a first valve and a second valve is in a closed position, according to an embodiment of the invention.

As shown in FIG. 5A, the spherical member 52 may elastically deform the protrusion 51*b* and may closely contact the curved portion 51*c* when the first valve 50 is in a closed position. At this time, the spherical member 52 may seal the slit 51*a* to prevent fluid communication between the ink outlet path 43*a* and the outside of the fluid cartridge 40.

A coil spring 53 may be disposed in tube 45 and fixed, at its base end, to a platform portion 45*a* formed on one end of the tube 45 and, at its free end, may be in contact with the spherical member 52. Thus, coil spring 53 may continuously exert a biasing force on the spherical member 52 in a direction urging the spherical member 52 toward the plug 51.

A cap 46 may be disposed at the other end of the tube 45 and outside the plug 51. The cap 46 may cover the plug 51 fitted into the other end of the tube 45 and may prevent the plug 51 from falling out of the tube 45. The cap 46 may have an opening 46*a* formed therethrough in its center. A portion of the plug 51, including the slit 51*a*, may be exposed through the opening 46*a*.

Figure 5B:
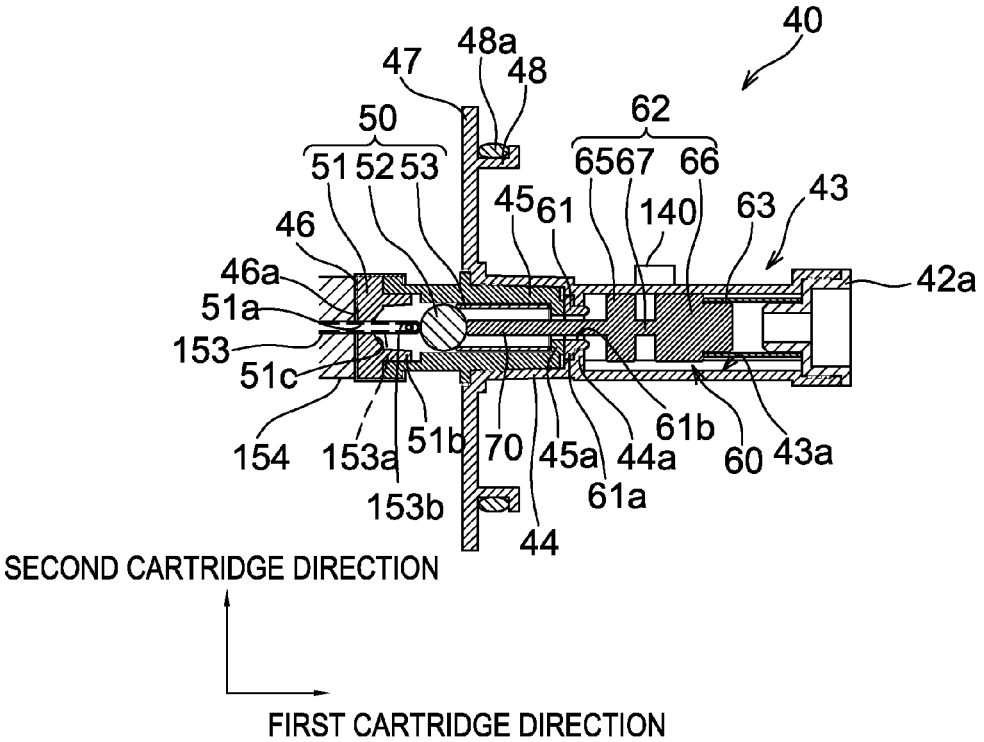
FIG. 5B is a partial cross-sectional view of the ink cartridge, in which each of a first valve and a second valve is in an open position, according to an embodiment of the invention.

As shown in FIGS. 5A and 5B, the second valve 60 may be disposed in the tube 44 and may comprise a valve seat 61, a valve body 62, and a coil spring 63. The valve body 62 may comprise a cylindrical first member 65, a cylindrical second member 66, and a connecting member 67. Connecting member 67 may be a rodlike member connecting the first and second members 65 and 66. The diameter of the connecting member 67 may be less than the diameters of the first and second members 65 and 66. A rodlike pressing member 70 may extend in the first cartridge direction from a center of an opposite surface of the first member 65 from a surface facing the second member 66. The diameter of the pressing member 70 may be less than the diameter of a hole 61*b* and may be substantially the same as the diameter of the connecting member 67. The pressing member 70 may be inserted into the hole 61*b*.

The valve seat 61 may comprise an elastic material, e.g. rubber, and may comprise a flange 61*a* positioned between the ring-shaped protrusion 44*a* of the tube 44 and the platform portion 45*a* of the tube 45. The valve seat 61 may have a through hole 61*b* formed through its center and extending in the first cartridge direction. The coil spring 63 may be fixed, at its base end, to the joint 42*a* and, at its free end, may be in contact with the valve body 62, such that the coil spring 63 may continuously exert a biasing force on the valve body 62 in a direction urging the valve body 62 toward the valve sheet 61. As shown in FIG. 5A, when the second valve 62 is in the closed position, the first member 65 makes contact with the valve seat 61 and seals the through hole 61*b*. Consequently, when the second valve 62 is in the closed position, fluid communication between the interior of the tube 44 and the interior of the tube 45 in the ink outlet path 43*a* is prevented, and fluid communication between the reservoir 42 and the outside of the fluid cartridge 40, via the ink outlet path 43*a*, is prevented. At this time when the second valve 62 is in the closed position, a portion of the valve seat 61 contacts the first member 65 and may be elastically deformed by the biasing force of the coil spring 63.

The sensor 140 may be a reflection-detecting type optical sensor comprising a light-emitting portion and a light-receiving portion. Sensor 140 may be configured to detect the presence or absence of an object in a predetermined range of positions without contacting the object whose presence or absence is detected. The sensor 140 may emit, from the light-emitting portion, an amount of light that corresponds to a signal input from the controller 100 via the contact 142. The amount of light emitted may correspond to an input value, e.g., a current value, represented by the signal input from the controller 100 to the sensor 140. The sensor 140 may output a signal representing the amount of light received by the light-receiving portion to the controller 100 via the contact 142.

As shown in FIG. 5A, when the second valve 60 is in the closed position, the sensor 140 may be disposed such that the entirety of the sensor 140 faces the second member 66 in the second cartridge direction. As shown in FIG. 5B, when the second valve 66 is in the open position, approximately half of the sensor 140 does not face the second member 66 in the second cartridge direction. A circumferential surface of the second member 66 may comprise a mirror-like surface configured to reflect light. When the second valve 60 is in the closed position, as shown in FIG. 5A, substantially all the light emitted from the light-emitting portion is reflected at the mirror-like surface and is received by the light-receiving portion. Thus, the sensor 140 may output a signal representing a relatively high current value to the controller 100, because most of the emitted light is received by the light-receiving portion.

That is, in an embodiment of the invention, the sensor may output a further data corresponding to a further value when the fluid communication between the reservoir 42 and the outside of the fluid cartridge 40, via the ink outlet path 43*a*, is prevented. In contrast, when the second valve 60 is in the open position, as shown in FIG. 5B, approximately half of the light emitted by the light-emitting portion is reflected at the mirror-like surface and is received by the light-receiving portion. The sensor 140 thus may output a signal representing a relatively low current value to the controller 100. That is, in an embodiment of the invention, the sensor may output a particular data corresponding to a particular value when reservoir 42 and the outside of the fluid cartridge 40 are in fluid communication. An output value, e.g., a current value, represented by a signal output from the sensor 140 is greater when the second valve 60 is in the closed position than when the second valve 60 is in the open position.

The memory 141 may comprise an electrically erasable programmable ROM (EEPROM) or the like, and may store data including characteristic information of the sensor 140, a date, e.g., year, month, and day, on which the characteristic information is written in the memory 141, a valid use period of the characteristic information, and a manufacture date of the fluid cartridge 40. The date on which the characteristic information is written in the memory 141, which is stored in the memory 141, is hereinafter interchangeably referred to as a "writing date." The writing date and the valid use period are information related to the use limit of the characteristic information. As will be described in more detail herein, at the time of manufacturing or refurbishing the fluid cartridge 40, the characteristic information may be written in the memory 141, along with the writing date of the characteristic information in the memory 141. The valid use period of the characteristic information may be determined based on Table 1 below and also may be written in the memory 141.

In Table 1, the valid use period of the characteristic information becomes shorter as the time elapsed since manufacture of the fluid cartridge 40 increases. This is because output characteristics of the sensor 40 are likely to fluctuate due to deterioration of the fluid cartridge 40 and specifically, deterioration of the portion to be detected, e.g., the second valve 60, with a lapse of time since manufacture. In an embodiment of the invention, a table, e.g., the table shown in Table 1, may be stored in a memory of a manufacturing device and a memory of the refurbishing device of the fluid cartridge 40.

TABLE 1

| | Time Elapsed Since Manufacture | | | | |
|---|---|---|---|---|---|
| | less than 1 year | 1 year or more and less than 2 years | 2 years or more and less than 3 years | 3 years or more and less than 4 years | 4 years or more |
| Valid Use Period of Characteristic Information | 2 years | 1.5 years | 1 year | 0.5 years | to be discarded |

FIGS. 5A-5B, 6A-6B, 7, and 12 show steps for mounting the fluid cartridge 40. In FIG. 12, electric power supply lines are shown in thick lines, and signal lines are shown in thin lines.

Referring to FIG. 5A, before the fluid cartridge 40 is mounted to the printer 1, the first valve 50 and the second valve 60 may be maintained in the closed positions. Referring to FIG. 12, at this stage, electric connection between the contact 142 and a contact 152 and between the electric power input portion 147 and an electric power output portion 157 is not yet established. Accordingly, no signals are transmitted between the fluid cartridge 40 and the printer 1, and no electric power is supplied to the sensor 140 or the memory 41.

Figure 6A:
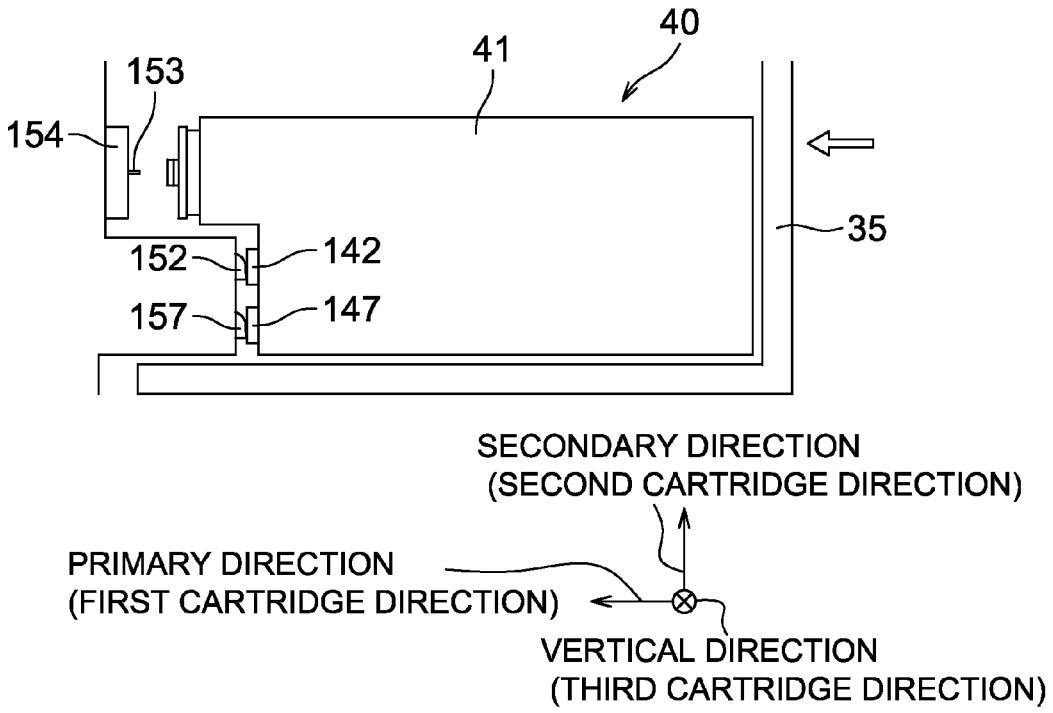
FIGS. 6A and 6B are partial plan views of the ink cartridge which is being mounted to the ink jet printer, according to an embodiment of the invention.
Figure 6B:
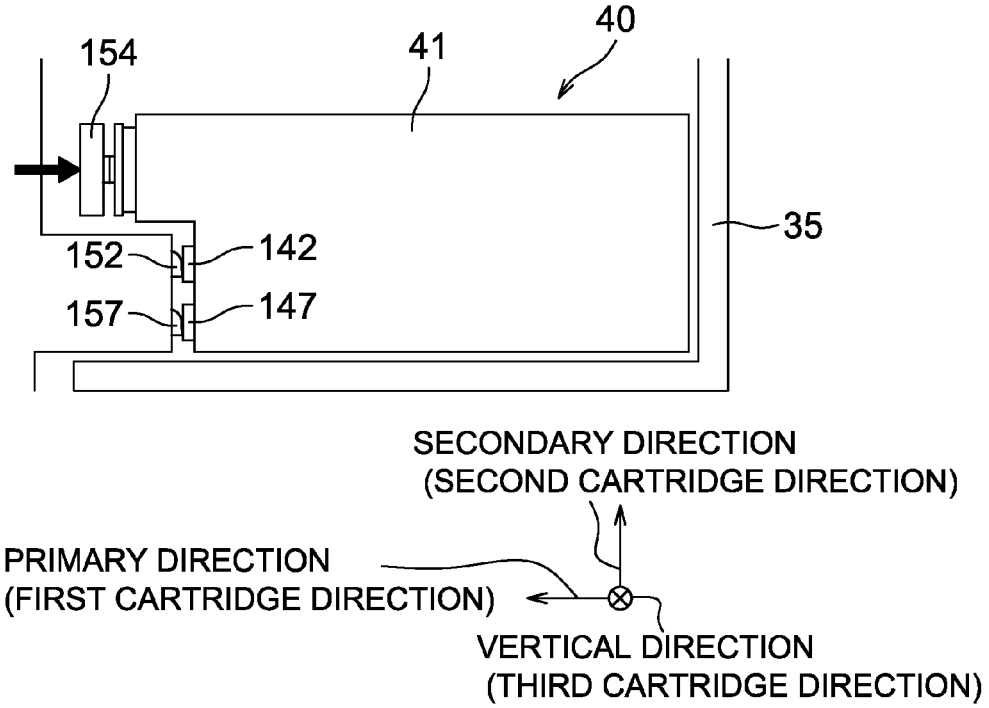

Referring to FIG. 2, in order to mount the fluid cartridge 40 to the printer 1, the fluid cartridge 40 may be placed together with other fluid cartridges 40 in the cartridge tray 35 of the printer 1, and the cartridge tray 35 may be inserted into the space C of the housing 1*a* in the primary direction, e.g., in a direction shown by an open arrow in FIG. 6A. Referring again to FIG. 6A, at this time, the contact 142 of the fluid cartridge 40 may make contact with the corresponding contact 152 of the printer 1 to establish electric connection between the fluid cartridge 40 and the printer 1. This allows the cartridge 40 and the printer 1 to transmit and receive signals therebetween. In an embodiment of the invention, the contact 152 is formed on a wall surface of the housing 1*a* and functions as an interface of the controller 100.

As shown in FIG. 6A, at substantially the same time when the contact 142 makes contact with the contact 152, the electric power input portion 147 of the fluid cartridge 40 makes contact with the electric power output portion 157 of the printer 1 to establish electric connection therebetween. Accordingly, as shown in FIG. 12, electric power may be supplied from an electric power source 158 to the sensor 140 and the memory 141 via the electric power output portion 157 and the electric power input portion 147. The electric power source 158 may be disposed in the housing 1*a* and may supply electric power to each component of the printer 1. The electric power output portion 157 may be electrically connected to the electric power source 158 and may be disposed on the wall surface of the housing 1*a* at a position facing the electric input portion 147 of the fluid cartridge 40, as shown in FIG. 6A. The electric power input portion 147 may be electrically connected to the sensor 140 and the memory 141, and may be disposed on an outer exposed surface of the housing 41 at a position adjacent to the contact 142. The contact 152 and the electric power output portion 157 may be provided for each of the fluid cartridges 40 placed on the cartridge tray 35.

In a state shown in FIG. 6A, the fluid cartridge 40 may be spaced away from, a hollow member, e.g., a hollow tube 153, and the reservoir 42 is not in fluid communication with the ink path of the head 2. The hollow tube 153 is fixed to a base portion configured to move in the primary direction relative to the housing 1*a*, and is in fluid communication with a tube attached to the joint of the head 2. The hollow tube 153 and the contact 152 are provided for each of the cartridges 40 placed in the cartridge tray 35.

Figure 7:
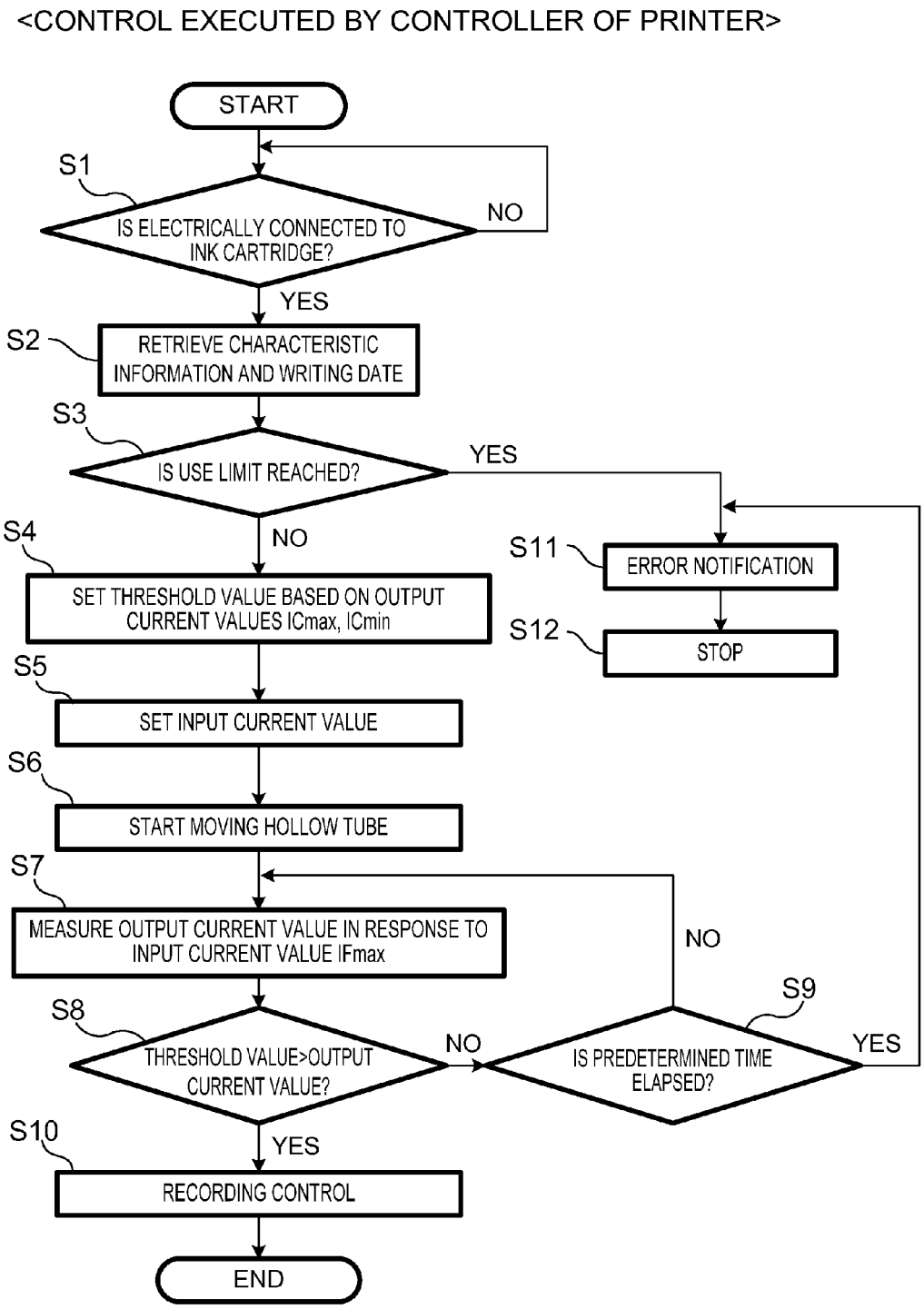
FIG. 7 is a flowchart showing control executed by a controller of the ink jet printer when the ink cartridge is mounted to the ink jet printer, according to an embodiment of the invention.

Referring to FIG. 7, in Step S1, the controller 100 may detect whether the fluid cartridge 40 and the controller 100 are electrically connected. When the controller 100 detects electric connection between the fluid cartridge 40 and the printer 1 in Step S1, e.g., "YES" at Step S1, the controller 100 may execute Steps S2 to S5, which will be described later, and may control, in Step S6, the moving mechanism 155 to move the base portion 154 and the hollow tube 153 in the primary direction, e.g., in the direction shown by a solid arrow in FIG. 6B. After controller 100 executes Step S6 in which the base portion 154 and the hollow tube 153 are started moving, the controller 100 may determines, in Steps S7 and S8, a position of the second valve 60 based on a current value output from the sensor 140.

As the hollow tube 153 is started moving in Step S6, the hollow tube 153 may be inserted through the opening 46*a* into the slit 51*a*. The diameter of the hollow tube 153 is greater than the diameter of the slit 51*a*. Thus, when the hollow tube 153 is inserted into the slit 51*a*, the plug 51 may be elastically deformed such that an inner circumferential surface of the plug 51, which defines the slit 51*a*, closely contacts an outer circumferential surface of the hollow tube 153, thereby creating an elastic seal, and preventing ink leakage from a gap between the slit 51*a* and the hollow tube 53.

A tip of the hollow tube 153 may contact and moves the spherical member 52 such that the spherical member 52 may separate from the plug 51. At this time, the first valve 50 may transition from the closed position to the open position. An opening 153*b* formed at the tip of the hollow tube 153 may be located in the interior of the tube 45, and an ink path 153*a* in the hollow tube 153 may be placed in fluid communication with the interior of the tube 45.

The spherical member 52, which previously separated from the plug 51, then may make contact with a tip of the pressing member 70. As the hollow tube 153 further enters the ink outlet path 43*a*, the pressing member 70 and the valve body 62 move, such that the first member 65 of the valve body 62 separates from the valve seat 61. At this time, the second valve 60 transitions from the closed position to the open position. The interior of the tube 45 may be placed in fluid communication with the interior of the tube 44 in the ink outlet path 43*a*, thereby placing the reservoir 42 and the outside of the fluid cartridge 40 in fluid communication via the ink outlet path 43*a*. As shown in FIG. 5B, when both the first valve 50 and the second valve 60 are in the open positions, the reservoir 42 may be in fluid communication with the ink path in the head 2, via the ink outlet path 43*a* and the ink path 153*a*.

In order to remove the fluid cartridge 40 from the printer 1, the cartridge tray 35 may be removed from the housing 1*a*. At this time, each of the four fluid cartridges 40 may be separated from the corresponding base portion 154, the corresponding contact 152, and the corresponding electric power output portion 157. Electric connection between the contact 142 and the contact 152 and between the electric power input portion 147 and the electric power output portion 157 thus may be disconnected. This disconnection may disable transmission and reception of signals between the fluid cartridges 40 and the printer 1 and also may stop electric power supply from the electric power source 158 to the sensor 140 and the memory 141. At this time, as the hollow tube 153 moves leftward with respect to FIG. 5B, the spherical member 52 moves toward the plug 51 while contacting the tip of the hollow tube 153 due to the biasing force of the coil spring 53. When the spherical member 52 makes contact with the plug 51, the first valve 50 transitions from the open position to the closed position. At this time, the valve body 62 and the pressing member 70 of the second valve 60 moves leftward in FIG. 5B due to the biasing force of the coil spring 63, and the first member 65 of the valve body 62 makes contact with the valve seat 61. Consequently, the second valve 60 transitions from the open position to the closed position, thereby preventing ink leakage from the reservoir 42.

FIG. 7 shows a flowchart detailing the control of each component of the printer 1 executed by the controller 100 when the fluid cartridge 40 is mounted to the printer 1, according to an embodiment of the invention. After the controller 100 detects electric connection between the fluid cartridge 40 and the printer 1, e.g., "YES" at Step S1, as described above, then in Step S2, controller 100 may retrieve, from the memory 141 of the fluid cartridge 40, data including the characteristic information, the writing date, and the valid use period of the characteristic information. The characteristic information may comprise information about an input value to the sensor 140, hereinafter interchangeably referred to as "input value data," and information about an output value from the sensor 140, hereinafter interchangeably referred to as "output value data." In an embodiment, the memory 141 may store both the input value data and the output value data, as will be described later.

Figure 8:
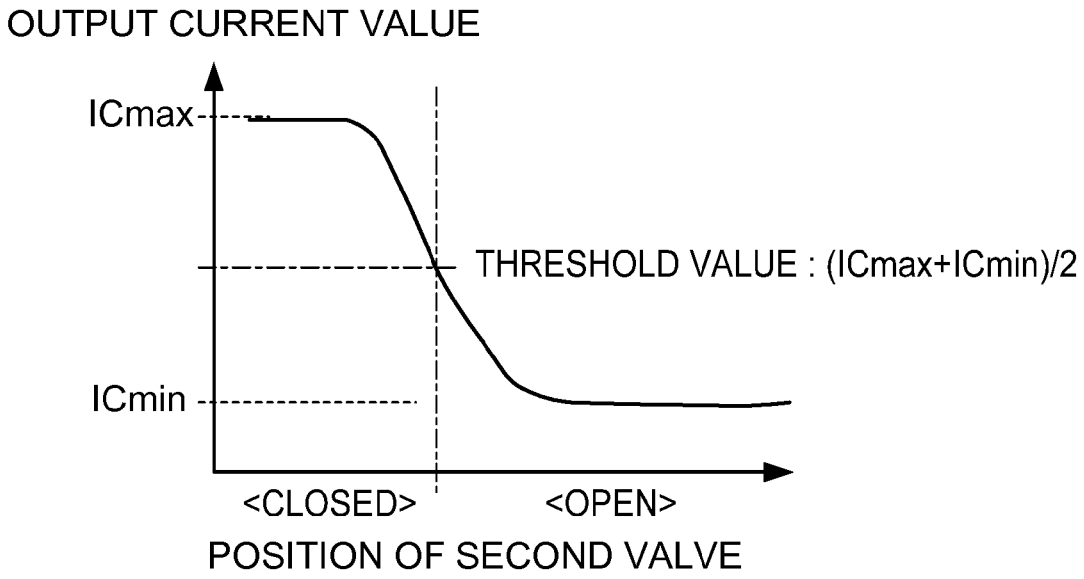
FIG. 8 is a graph showing the relation between the position of the second valve and the output current value from a sensor of the ink cartridge, according to an embodiment of the invention.

Referring to the graph shown in FIG. 8, the memory 141 may store, as the output value data, first data corresponding to a first value, e.g., output current value ICmax, and second data corresponding to a second value, e.g., output current value ICmin. In a graph of FIG. 8, the horizontal axis may represent the position of the second valve 60, and the vertical axis may represent the output current value from the sensor 140. The output current values ICmax and ICmin may be current values output from the sensor 140 when a predetermined input current value is input to the sensor 140 in a state where the second valve is in the closed position and in the open position, respectively.

In an embodiment of the invention, the output current values ICmax and ICmin may be defined such that one half of a sum of ICmax and ICmin is between the particular data corresponding to the particular value outputted by sensor 140 when the reservoir 42 and the outside of the fluid cartridge 40 are in fluid communication, and the further data corresponding to the further value outputted by sensor 140 when reservoir 42 and the outside of the fluid cartridge 40 are not in fluid communication. In addition, ICmax and ICmin may be further defined such that the particular data outputted by the sensor is less than or equal to one half of the sum of ICmax and ICmin, and such that the further data outputted by the sensor is greater than one half of the sum of ICmax and ICmin.

In another embodiment of the invention, the memory 141 may be configured to store at least one of the particular data corresponding to the particular value and the further data corresponding to the further value, which may be outputted by sensor 140 as described previously.

The predetermined input current value is e.g., an input current value IFmax, which will be described in more detail herein. When the second valve 60 is in an intermediate position between the closed position and the open position, the output current value from the sensor 140*a* is between the output current values ICmax and ICmin.

Figure 9:
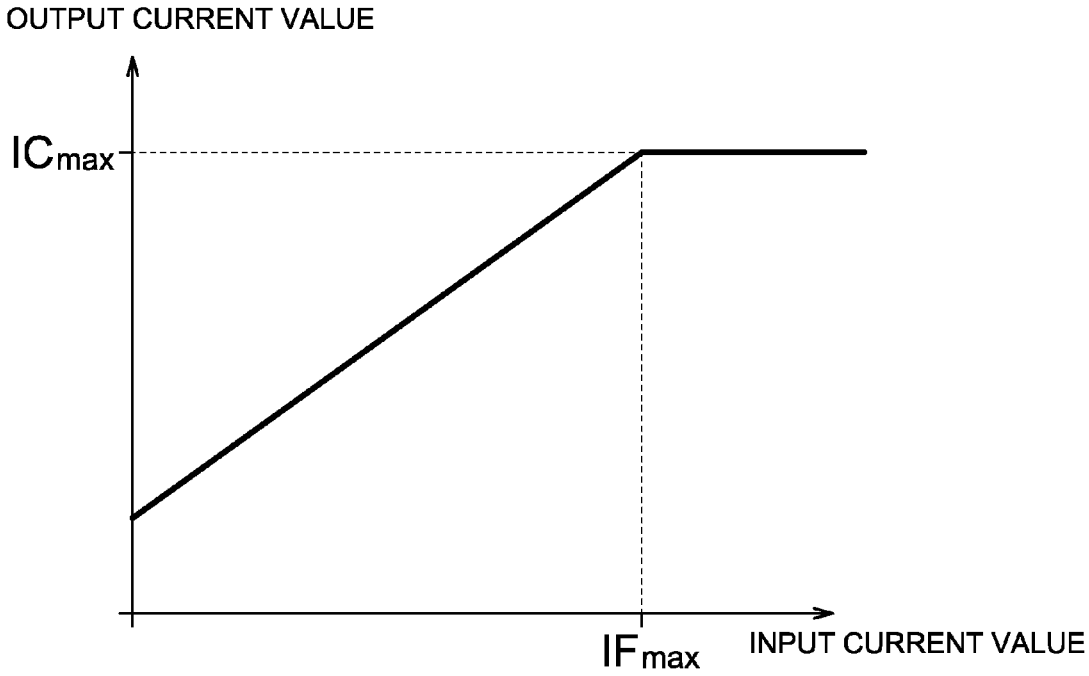
FIG. 9 is a graph showing the relation between the input current value to the sensor and the output value from the sensor, according to an embodiment of the invention.

The memory 141 may store, as the input value data, the input current value, e.g., the input current value IFmax shown in FIG. 9, which, when input to the sensor 140, may cause the output current value from the sensor 140 to be saturated. As shown in FIG. 9, the output current value from the sensor 140 may be proportional to the input current value to the sensor 140 until the input current value reaches the input current value IFmax. Once the input current value reaches the input current value IFmax, the output current value may be saturated. In other words, when the input current value is equal to or greater than the input current value IFmax, e.g., when the input current value IFmax, the output current value is equal to a saturated output current value ICmax, e.g., output current value=ICmax.

Referring back to FIG. 7, in Step S3, the controller 100 may determine whether the use limit of the characteristic information is reached, based on the data retrieved in Step S2. Specifically, the controller 100 may calculate a time elapsed since the characteristic information was written in the memory 141, based on the writing date, e.g., the year, month, and day, retrieved in Step S2 and a present date, e.g., the year, month, and day, which in an embodiment of the invention, may be obtained from a timer built in the printer 1. The controller 100 determines that the use limit of the characteristic information is not reached, e.g., determines "NO" at Step S3 when the elapsed time is less than the valid use period of the characteristic information. The controller 100 determines that the and that the use limit of the characteristic information is reached, e.g., determines "YES" at Step S3, when the elapsed time is not less than the valid use period of the characteristic information.

When the controller 100 determines that the use limit of the characteristic information is reached, e.g., "YES" at Step S3, then in Step S11, controller 100 may notify an error in by displaying an image on a display or by outputting a voice, and in Step S12, controller 100 may stop operations of each component of the printer 1 to disable recording operations.

When the controller 100 determines that the use limit of the characteristic information is not reached, e.g., "NO" at Step S3, then in Step S4, the controller 100 may set a threshold value as an output reference value from the sensor 140, based on the output current values ICmax and ICmin retrieved in Step S2. The threshold value may be a current value output from the sensor 40 when the second valve 60 is in an intermediate position between the open position and the closed position. In an embodiment, the threshold value is set to be (ICmax+ICmin)/2, as shown in FIG. 8.

In Step S5, the controller 100 may set a current value to be input to the sensor 140, e.g., input current value IFmax, based on the input value data retrieved in Step S2, and may input the current value to the sensor 140. Consequently, the light-emitting portion may emit light having a light amount corresponding to the input current value. Subsequently, the controller 100 may execute Steps S6-S8. Specifically, in Step S6, the controller 100 may control the base portion 154 and the hollow tube 153 supported by the base portion 154 to start moving in the solid arrow direction shown in FIG. 6A. In Step S7, the controller 100 may measure a current value output from the sensor 140, and in Step S8, the controller 100 may determine whether or not the output current value is less than the threshold value. In this embodiment, the controller 100 may determine that the second valve 60 is in the open position when the output current value is less than the threshold value, and may determine that the second valve 60 is in the closed position when the output current value is not less than the threshold value.

When the controller 100 determines that the output current value is less than the threshold value, e.g., "YES" at Step S8, e.g., determines that the second valve changes from the closed position to the open position, the controller 100 then may execute recording control in Step S10, and then may complete the routine. After Step S6, when a predetermined time is elapsed before the output current value reaches the threshold value in Step 9, e.g., "YES" at Step S9: YES, then controller 100 may notify an error in Step S11 and may stop the routine in Step S12. In this case, controller 100 may assume that there is a problem with the sensor 40 or the valves 50 and 60 of the cartridge 40, or the hollow tube 53 or the moving mechanism 155 of the printer 1.

In Step S10, the controller 100 may execute recording control, upon receiving a recording instruction from an external device, by driving the sheet feed motor 125, the transport motor 127, and the feed motor 128 and the heads 2 as shown in FIG. 12. During Step S10, the controller 100 may execute Steps S7 and S8 for detecting the position of the second valve 60 at predetermined time intervals. The second valve 60 may be required to remain in the open position during recording operations. When the controller 100 determines that the second valve 60 is in the closed position, the controller 100 may notify an error at Step S11 and may stop the routine at Step S12. In an embodiment, when a plurality of fluid cartridges 40 are mounted simultaneously to the printer 1, a series of steps shown in FIG. 7 may be executed substantially simultaneously.

Figure 10:
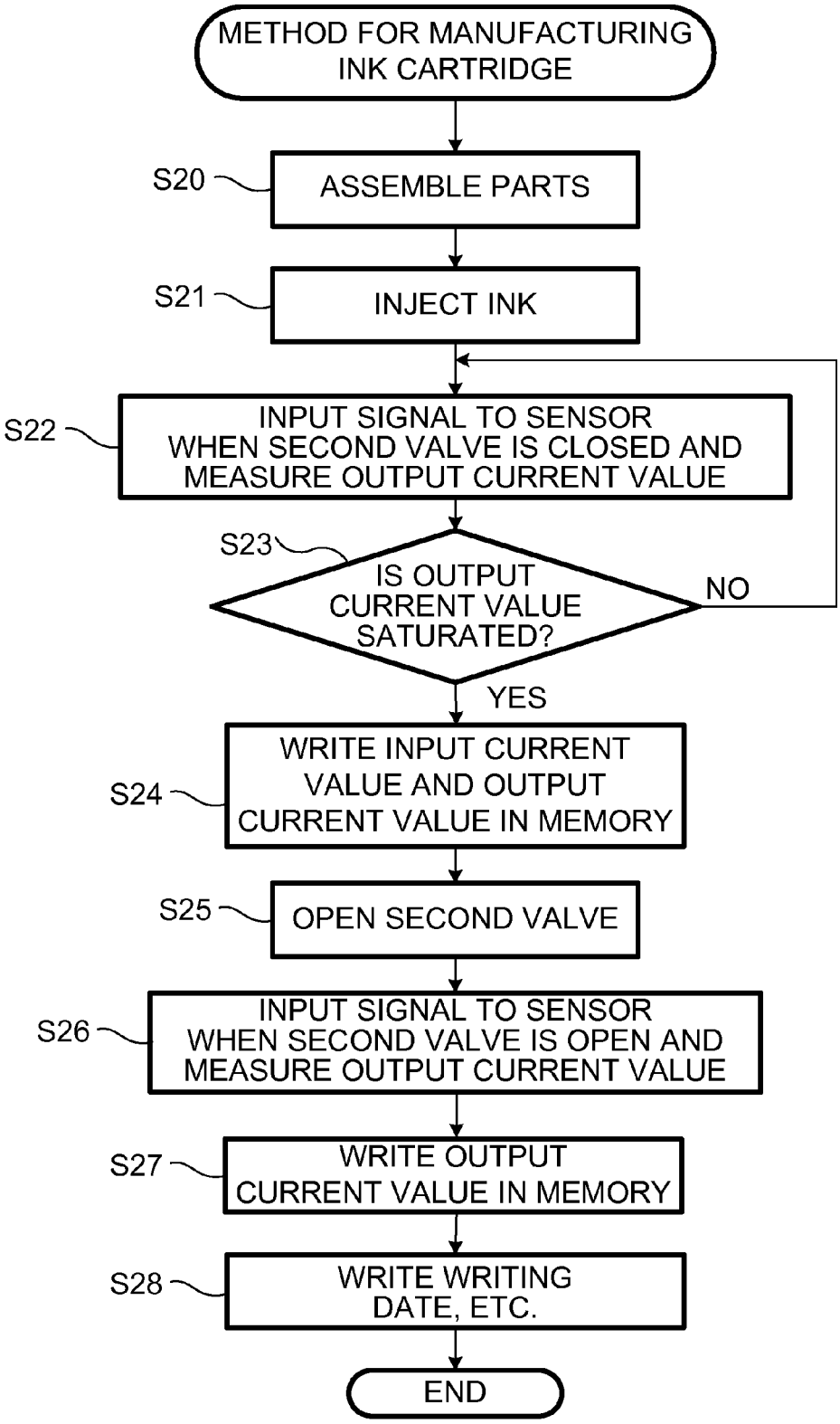
FIG. 10 is a flowchart showing a method for manufacturing the ink cartridge, according to an embodiment of the invention.

FIG. 10 shows a method for manufacturing the fluid cartridge 40 according to an embodiment of the invention. Steps for manufacturing the fluid cartridge 40 may be executed by either a manufacturing device or a worker. In an embodiment, all the steps are executed by a manufacturing device that comprises an injector, a controller, and a display.

First, in Step S20, all parts of the fluid cartridge 40, e.g., the housing 41, reservoir 42, ink outlet tube 42, first valve 50, second valve 60, cap 46, sensor 140, memory 41, and contact 142, may be assembled to each other. Specifically, the reservoir 42, ink outlet tube 43, first valve 50, second valve 60, sensor 140, etc. may be assembled into the housing 41.

In Step S21, the ink injector may inject liquid, e.g., ink, into the reservoir 42. Ink may be injected when the second valve 60 is shifted from the closed position to the open position, e.g., by inserting a pressing bar of the injector from the other end of the tube 45 into the tube 45 so as to press the valve body 62 against the biasing force of the coil spring 63. When the pressing bar is withdrawn from the other end of the tube 45 after ink injection is completed, the second valve 60 may be transitioned from the open position to the closed position by the biasing force of the coil spring 63.

In Step S22, while the manufacturing device maintains the second valve 60 in the closed position, a controller of the manufacturing device may input a signal to the sensor 140 and measures an output current value from the sensor 140. The controller may gradually increase an input current value to the sensor 140 in Step S22. When the output current value from the sensor 140 becomes saturated in Step 23, e.g., "YES" at Step S23, then in Step S24, the controller may write the input current value, e.g., the input current value IFmax shown in FIG. 9 causing the output current value to be saturated, and the output current value, e.g., the saturated output current value ICmax shown in FIGS. 8 and 9, into memory 141.

In Step S25, the manufacturing device may shift the second valve 60 from the closed position to the open position, e.g., by inserting the pressing bar of the injector from the other end of the tube 45 into the tube 45 so as to press the valve body 62 against the biasing force of the coil spring 63. In Step S26, while the manufacturing device maintains the second valve 60 in a predetermined open position, the controller may input to the sensor 140 a signal representing the input current value IFmax written in the memory 141, and may measure a current value output from the sensor 140. In Step 27 S27, the controller may write, in the memory 141, the output current value, e.g., the output current value ICmin shown in FIG. 8, measured in step 26. In Step S28, the controller further may write, in the memory 141, the date, e.g., the year, month, and day, of writing data in the memory 141, the valid use period of the characteristic information, e.g., 2 years according to Table 1 in this embodiment, and the manufacture date of the fluid cartridge 40. Thus, manufacturing of the fluid cartridge 40 may be completed.

Figure 11:
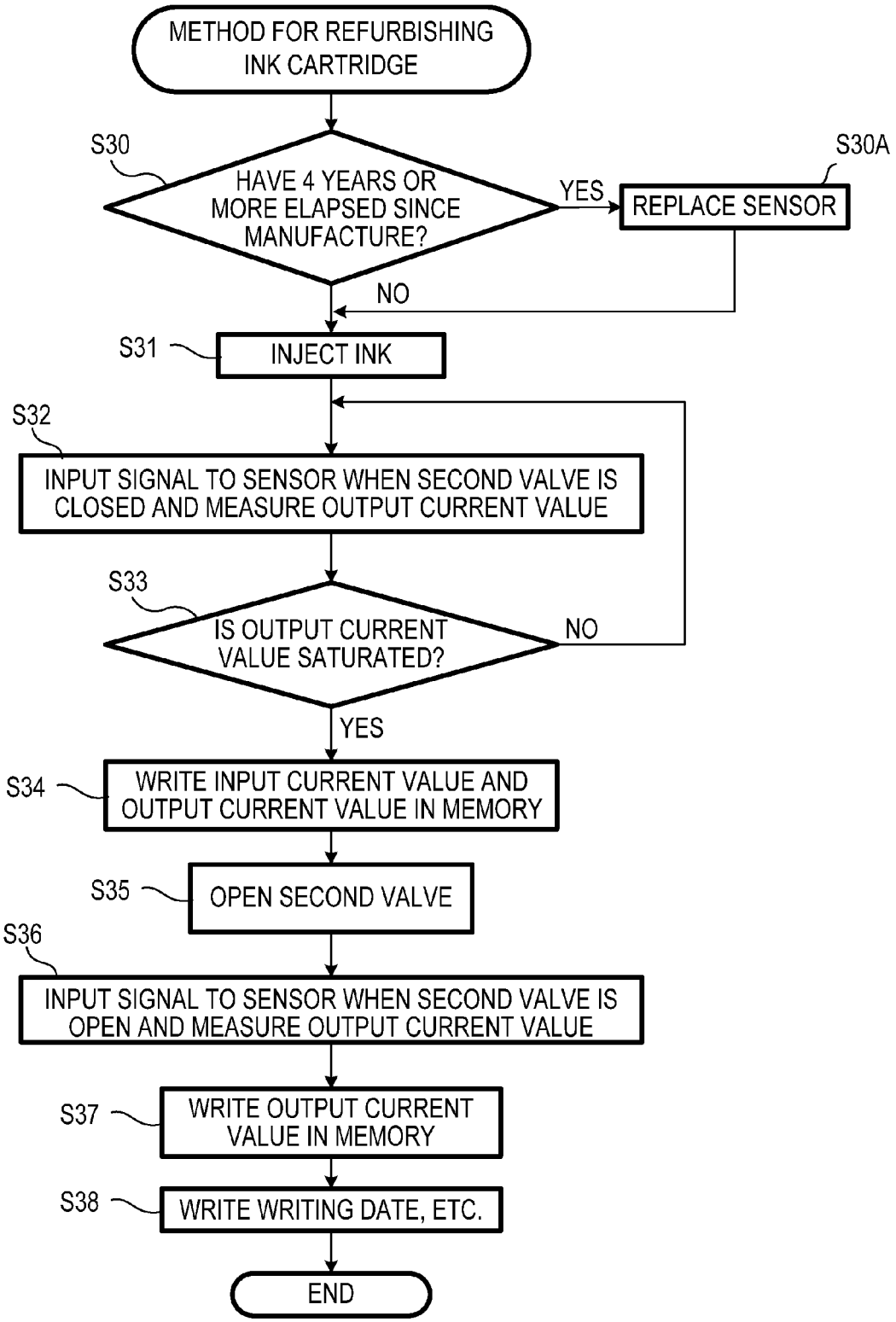
FIG. 11 is a flowchart showing a method for refurbishing the ink cartridge, according to an embodiment of the invention.

FIG. 11 shows a method for refurbishing the fluid cartridge 40 according to an embodiment of the invention. Steps for refurbishing the fluid cartridge 40 may be executed by either a refurbishing device or a worker. In an embodiment, all the steps are executed by a refurbishing device that comprises an injector, a controller, and a display.

First, in Step S30, a controller of the refurbishing device may determine whether 4 years or more have elapsed since the manufacture date of the fluid cartridge 40 which is subjected to refurbishing. Specifically, the controller may retrieve the manufacture date of the fluid cartridge 40 from the memory 141 and may calculate the time elapsed since the manufacture date, based on the retrieved manufacture date and a present date obtained from a built-in timer, and may determine whether 4 years or more have elapsed since the manufacture date.

As shown in Table 1, when the controller determines that 4 years or more have elapsed since the manufacture date, e.g., "YES" at Step S30, then in Step S30A, the refurbishing device may replace the sensor 140 built in the fluid cartridge 40 with a new one. In an embodiment, the old sensor 140 may be discarded. At this time, the second valve 40 also may be replaced with a new one. When the elapsed time since the manufacture date is less than 4 years, e.g., "NO" at Step S30, the refurbishing device may omit Step S30A. In Step S31, the injector of the refurbishing device may inject ink into the reservoir 42, similarly to Step S21 of the previously-described manufacturing method.

In Step S32\, while the refurbishing device maintains the second valve 60 in the closed position, the controller may input a signal to the sensor 140 and may measure a current value output from the sensor 140. In Step S33, the controller gradually may increase a current value input to the sensor 140. When the current value output from the sensor 140 becomes saturated, e.g., "YES" in Step S33, then in Step S34, the controller may write the input current value, e.g., input current value IFmax shown in FIG. 9, and the output current value, e.g., saturated output current value ICmax shown in FIGS. 8 and 9, at the time of saturation of the output current value in the memory 141. Thus, the characteristic information in the memory 141 of the fluid cartridge 40 may be updated.

In Step S35, similarly to Step S25, the refurbishing device may transition the second valve 60 from the closed position to the open position. In Step S36, while the refurbishing device maintains the second valve 60 in a predetermined open position, the controller may input a signal representing the input current value IFmax written in the memory 141 to the sensor 140, and may measure a current value output from the sensor 140. In Step S37, the controller may write, in the memory 141, the output current value, e.g., the output current value ICmin shown in FIG. 8, measured in Step S36, as updated characteristic information of the fluid cartridge 40.

In Step S38, the controller further may write, in the memory 141, the date of writing the updated characteristic information, e.g., the writing date, and the valid use period of the characteristic information. At this time, the controller may determine the valid use period of the characteristic information based on Table 1. Specifically, the valid use period of the characteristic information may be determined as 2 years when Step S30A has been executed, similarly to when the fluid cartridge 40 is manufactured. When Step S30A has not been executed, the valid use period is determined based on the elapsed time since the manufacture date calculated in Step S30 and Table 1. The controller may update the valid use period of the characteristic information stored in the memory 141, when necessary.

Further, when Step S30A has been executed, the controller may change the manufacture date stored in the memory 141 to the date on which the fluid cartridge 40 is refurbished. Accordingly, "since manufacture" in Table 1 and in Step S30 of FIG. 11 means "since completion of manufacturing Step S28" for a fluid cartridge 40 which has not yet undergone Step S30A, and means "since completion of the latest refurbishing Step S38" for a fluid cartridge 40 which has undergone Step S30A. In this way, refurbishing of the fluid cartridge 40 is completed.

When the fluid cartridge 40 which is manufactured or refurbished by the above described manufacturing or refurbishing method is mounted to the printer 1, the controller 100 of the printer 1 may execute the control shown in FIG. 7, regardless of whether the fluid cartridge 40 is new or refurbished. As described above, in the fluid cartridge 40, the printer 1, and the method for manufacturing or refurbishing the fluid cartridge 40 according to the first embodiment, the fluid cartridge 40 comprises the memory 141 storing the characteristic information of the sensor 140. This may reduce the number of fluid cartridges 40 that are discarded when they are manufactured or refurbished. Accordingly, manufacturing and refurbishing efficiency of fluid cartridges 40 may increase while reducing manufacturing and refurbishing cost and environmental impact.

In addition, the printer 1 may retrieve the characteristic information of the sensor 140 from the memory 141 of the fluid cartridge 40, and may use the retrieved characteristic information to determine the position of the second valve 60. This allows the printer 1 to determine the position of the second valve 60 based on a signal input to the sensor 140 and a signal output from the sensor 140 while taking into account the varying characteristic information depending on the inconsistencies between various sensors 140 in various fluid cartridges 40. Accuracy of the sensor 140 in detection thus may be ensured while reducing or eliminating various problems which may occur when the sensor 140 is used without consideration of its characteristic information. The problems include an increase in manufacturing and refurbishing cost resulting from discard of fluid cartridges 40, a detection failure of the sensor 140, an increase in number of parts resulting from providing an adjusting circuit, and a need for screening of fluid cartridges 40.

The memory 141 of the fluid cartridge 40 may store, as the characteristic information of the sensor 140, both the input value data to the sensor 140 and the output value data from the sensor 140. This may allows the controller 100 of the printer 1 to accurately determine the position of the second valve 60.

The memory 141 of the fluid cartridge 40 may store, as the characteristic information of the sensor 140, the input current value, e.g., input current value IFmax at the time of saturation of the output current value. The controller 100 of the printer 1 may input the input current value IFmax to the sensor 140 (Step S5), may measure the output current value from the sensor 140 (Step S7), and may determine the position of the second valve 60 based on the output current value and the threshold value (Step S8). The accuracy of the sensor 140 in detection may increase by the use of the input current value which saturates the output current value, as a current value input for the sensor 140 to detect the second valve 60.

The memory 141 of the fluid cartridge 40 may store, in addition to the characteristic information, information about the use limit of the characteristic information, e.g., writing date and valid use period of the characteristic information. The controller 100 of the printer 1 may determine whether the use limit of the characteristic information is reached, based on the information about the use limit of the characteristic information. Because the output characteristics of the sensor 140 may change as time elapses, a determination in Step S3 may prevent adverse effect on recording operations and a failure of the printer 1 resulting from of erroneous detection of the position of the second valve 60.

As shown in FIG. 5B, the second valve 60 may move as the hollow tube 153 enters the ink outlet path 43*a*. The controller 100 may detect the entrance of the hollow tube 153 into the ink outlet path 43*a* based on the detected position of the second valve 60 in Step S8. The amount of ink flowing in the ink outlet path 43*a* may be adjusted by the movement of the second valve 60 in the ink outlet path 43*a*. Thus, the movement of the second valve 60 may be a factor for ink supply from the reservoir 42 to the head 2. If the detections made by sensor 140 are inaccurate, an adverse effect on recording operations or a failure of the printer 1 may result. In an embodiment of the invention, as described above, the controller 100 of the printer 1 notifies an error and stops the control routine when the use limit of the characteristic information is reached and when the second valve 60 moves to the closed position during recording operations. This may prevent or reduce an adverse effect on recording operations.]

In the method for manufacturing or furbishing the ink cartridge according to the above-described embodiment, output values from the sensor 140 are measured after ink injection, i.e., in a state similar to a state where the printer 1 executes recording operations, e.g., a state in which ink may be stored in the reservoir 42, which may improve reliability of the sensor 140.

Figure 13:
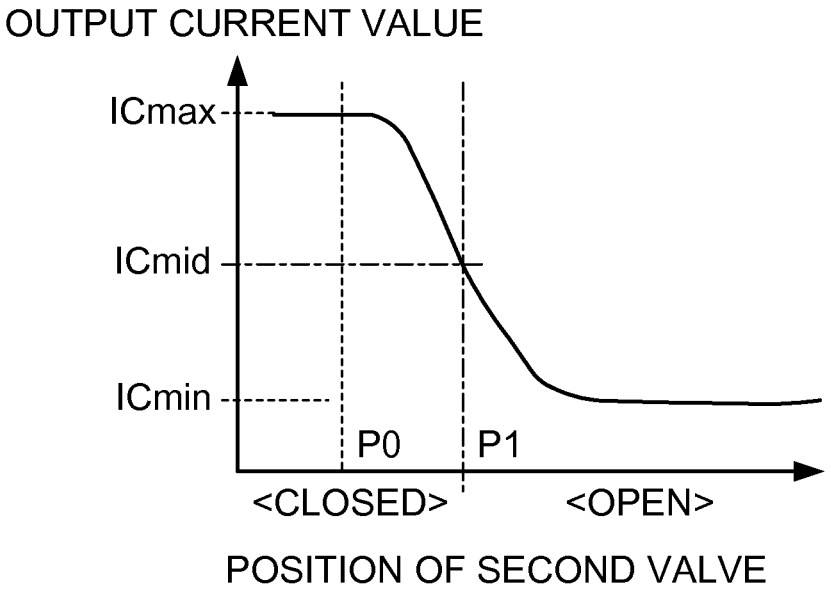
FIG. 13 is a graph and illustrating information which relates to the output current value from a sensor of an ink cartridge and is stored in a memory of the ink cartridge, according to another embodiment of the invention.

FIG. 13 shows another embodiment of the invention. An ink cartridge in the another embodiment may have substantially the same structure as the fluid cartridge 40 in the first described embodiment except for output current data stored in a memory of the ink cartridge. In the another embodiment, the memory of the ink cartridge may store an output current value ICmid, shown in FIG. 13, instead of the output current values ICmax and ICmin. In the graph shown in FIG. 13, the horizontal axis represents the position of the second valve 60, and the vertical axis represents the output current value from the sensor 140, similarly to the graph of FIG. 8. The output current value ICmid is a current value output from the sensor 140 when the second valve 60 is in an intermediate position between the closed position and the open position. Specifically, the output current value ICmid, which is between the output current values ICmax and ICmin, is a current value output from the sensor 140 when the second valve 60 is located in a position P1 which is shifted by a predetermined distance from a position P0 in which the second valve 60 begins to move from a completely closed state.

As described above, in the another embodiment, in Step S4, a controller 100 of a printer 1 may the output current value ICmid retrieved from the memory of the ink cartridge, as a threshold value, instead of calculating the value as described above. This may increase the processing speed of the controller because there is no need for the controller to calculate the threshold value.

Figure 14A:
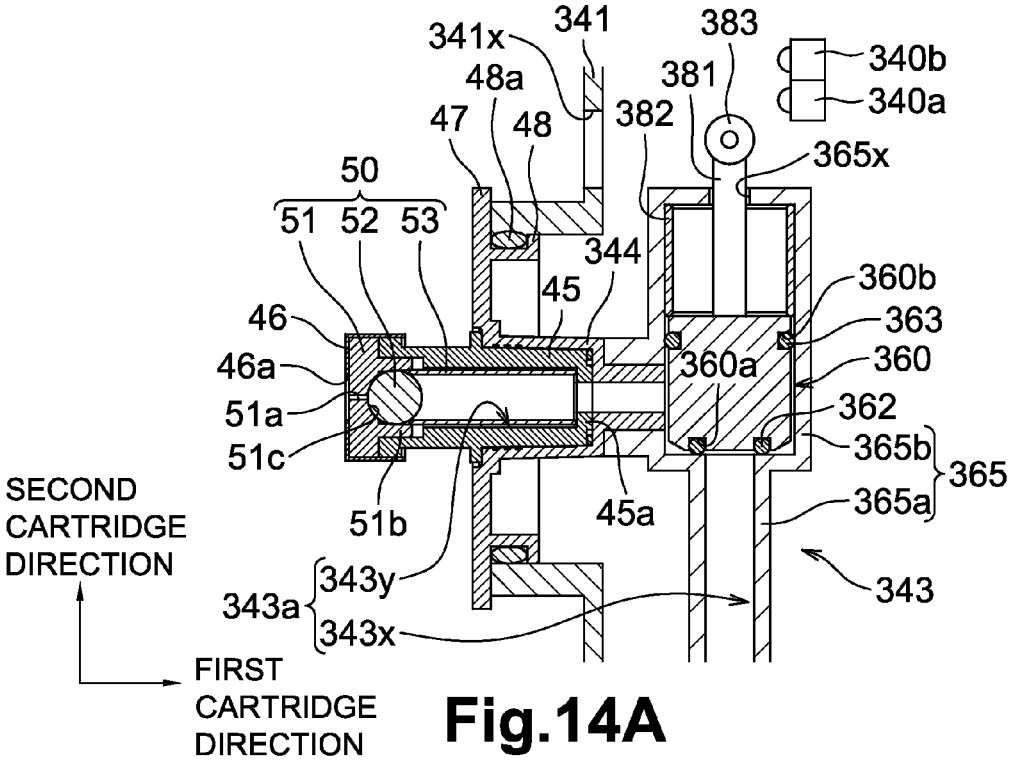
FIG. 14A is a partial cross-sectional view of an ink cartridge according to a yet another embodiment of the invention, in which each of a first valve and a second valve is in a closed position.
Figure 14B:
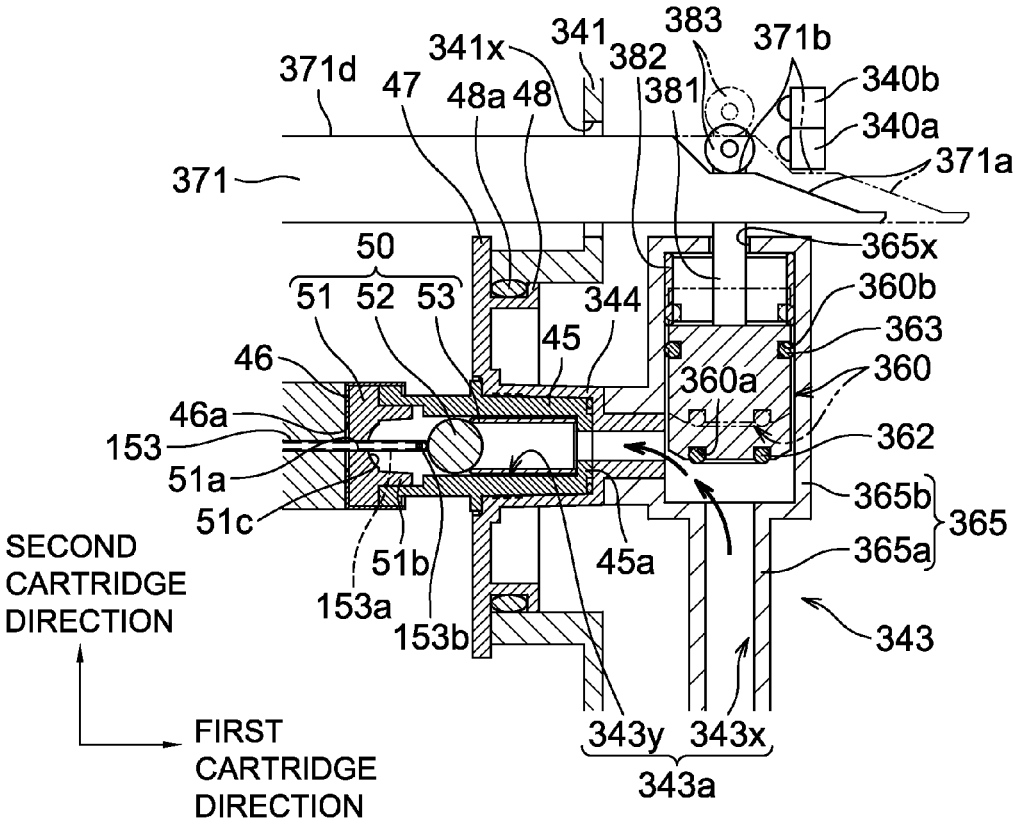
FIG. 14B is a partial cross-sectional view of an ink cartridge according to a yet another embodiment of the invention, in which each of a first valve and a second valve is in an open position.

FIGS. 14A-14B show yet another embodiment of the invention. An ink cartridge in yet another embodiment may have substantially the same structure of the fluid cartridge 40 in the first described embodiment except for a movable member, e.g., a second valve, and an ink outlet tube which houses the second valve. Like numerals are used for like corresponding parts in these embodiments, and a description of those like parts is omitted.

In the yet another embodiment, an ink outlet tube 343 may comprise three tubes 365, 344, and 45 connected to each other. The tube 365 may extend in the second cartridge direction and may comprise a small diameter portion 365*a* and a large diameter portion 365*b* having a larger diameter than the small diameter portion 365*a*. The small diameter portion 365*a* may be connected, at one end, to a reservoir 42, and the large diameter portion 365*b* may be connected to one end of the tube 344. The tube 45 may be fitted into the other end of the tube 344. The ink outlet tube 343 may define an interior 343*x* of the tube 365 and an interior 343*y* of the tubes 45 and 344. The two interiors 343*x* and 343*y* may be continuous, and may form an ink outlet path 343*a*.

A movable member, e.g., a second valve 360 may be disposed in the large diameter portion 365*b* and may have a substantially cylindrical shape. The second valve 360 may have, in its bottom surface and side surface, ring grooves 360*a* and 360*b*, respectively. O-rings 362 and 363 may be disposed in the grooves 360*a* and 360*b*, respectively, and may seal a gap between the second valve 360 and an inner surface of the large diameter portion 365*b*.

A coil spring 382 may be disposed in the large diameter portion 365*b*. The coil spring 82 is, at its one end, is in contact with the second valve 360 and, at its other end, in contact with a wall of the large diameter portion 365*b* so as to continuously exert a biasing force on second valve 360 in an urging direction toward the small diameter portion 365*a*.

The second valve 360 may be connected, via a connecting rod 381, to a roller 383 disposed outside the large diameter portion 365*b*. The connecting rod 381 may be fixed, at its one end, to the second valve 360 and, at its other end, rotatably may support the roller 383. The connecting rod 381 may be inserted into a hole 365*x* formed through the wall of the large diameter portion 365*b*. One end of the connecting rod 381 may be disposed in the large diameter portion 365*b*, and the other end may be disposed outside the large diameter portion 365*b*. The second valve 360, the connecting rod 381, and the roller 383 may be configured to move unitarily in the second cartridge direction, e.g., the vertical direction as shown in FIG. 14A.

As shown in FIG. 14B, as an entering rod 371 of a printer enters a housing 341, the roller 383 and the second valve 360 may selectively transition between three positions which are spaced apart from each other in the second cartridge direction. The housing 341 has substantially the same structure as the housing 41 in the first described embodiment, but may have a through hole 341*x* at a position opposed to the roller 383 in the first cartridge direction, such that the entering rod 371 may be inserted into the through hole 341*x*. The entering rod 371 may extend in the first cartridge direction, may be formed into a stepped shape, and may have a curved tapered surface 371*a*, a flat intermediate surface 371*b*, a curved inclined surface 371*c*, and a flat surface 371*d*, in this order from its tip.

FIG. 14A shows the roller 383 and the second valve 360 located in a first position which is the lowest among the three positions. In this first position, the second valve 60 is in the closed position, and the interiors 343*x* and 343*y* are not in fluid communication with each other. Thus, fluid communication between the reservoir 42 and the outside of the ink cartridge, via the ink outlet path 343*a*, is prevented.

FIG. 14B shows, in solid lines, the roller 383 and the second valve 360 located in a second position which is an intermediate position among the three positions. In the second position of roller 383, the second valve 360 is in the open position, for permitting a relatively small amount of ink flow. Fluid communication between the interiors 343*x* and 343*y* is permitted such that fluid communication between the reservoir 42 and the outside of the ink cartridge is permitted, via the ink outlet path 343*a*, to a degree that is less than the third position, discussed immediately herein.

FIG. 14B shows, in broken lines, the roller 383 and the second valve 360 located in a third position which is the highest among the three positions. In the third position of roller 383, the second valve 360 is in the open position for permitting a relatively large amount of ink flow, compared to the second position of roller 383. Fluid communication between the interiors 343*x* and 343*y* is permitted such that fluid communication between the reservoir 42 and the outside of the ink cartridge is permitted, via the ink outlet path 343*a*, to a greater degree than when the second valve 360 is in the second position.

In the yet another embodiment, the ink cartridge may comprise two sensors 340*a* and 340*b*, instead of the sensor 140 in the first embodiment. Each sensor may be a reflection-detecting type optical sensor comprising a light-emitting portion and a light-receiving portion, and may be disposed in a housing 341 of the ink cartridge. The light-emitting portion of each sensor may emit light in the first cartridge direction, e.g., leftward as shown in FIGS. 14A-14B. A circumferential surface of the roller 383 may comprise a mirror-like surface configured to reflect light.

As shown in FIG. 14A, when the roller 383 and the second valve 360 are in the first position, e.g., when the second valve 60 is in the closed position, neither of the sensors 340*a* and 340*b* face the roller 383 in the first cartridge direction. Light emitted from the light-emitting portion thus is not reflected at the circumferential surface of the roller 383, and the light-receiving portion receives no reflected light and outputs a signal representing a relatively low current value.

When the entering rod 371 is controlled by the controller 100 of the printer to move in the first cartridge direction and enter the housing 341 via through hole 341*x*, the roller 383 moves along the tapered surface 371*a* from the first position shown in FIG. 14A to the second position shown in solid lines in FIG. 14B, and may be placed on the intermediate surface 371*b*. At this time, the roller 383 and the second valve 360 may be located in the second position, and the second valve 360 may be in the open position for permitting a relatively small amount of ink flow. At this time, the sensor 340*a* may face the roller 383 in the first cartridge direction, and the light-receiving portion may receive light emitted from the light-emitting portion and reflected at the mirror-like surface of the roller 383, and may output a signal representing a relatively high current value. The sensor 340*b* does not face the roller 383 yet and outputs a signal representing a relatively low current value.

When the entering rod 371 is controlled by the controller 100 to further enter the housing 341, the roller 383 moves along the intermediate surface 371*b* and the inclined surface 371*c* from the second position shown in solid lines in FIG. 14B to the third position shown in broken lines in FIG. 14B, and is placed on the flat surface 371*d*. At this time, the roller 383 and the second valve 360 may be in the third position, and the second valve 360 may be in the open position for permitting a relatively large amount of ink flow. At this time, the sensor 340*b* may face the roller 383 in the first cartridge direction, and the light-receiving portion receives light emitted from the light-emitting portion and reflected at the mirror-like surface of the roller 383 and outputs a signal representing a relatively high current value.

The controller 100 may measure the output current values from the sensors 340*a* and 340*b*, and determines the position of the roller 383 and the second valve 360 based on changes in the output current values. The movement of the roller 383 may be timed to the insertion of a hollow tube 143 such that the roller 383 may move from the first position to the second position simultaneously with or after the insertion of the hollow tube 153 into a slit 51*a*.

Figure 15A:
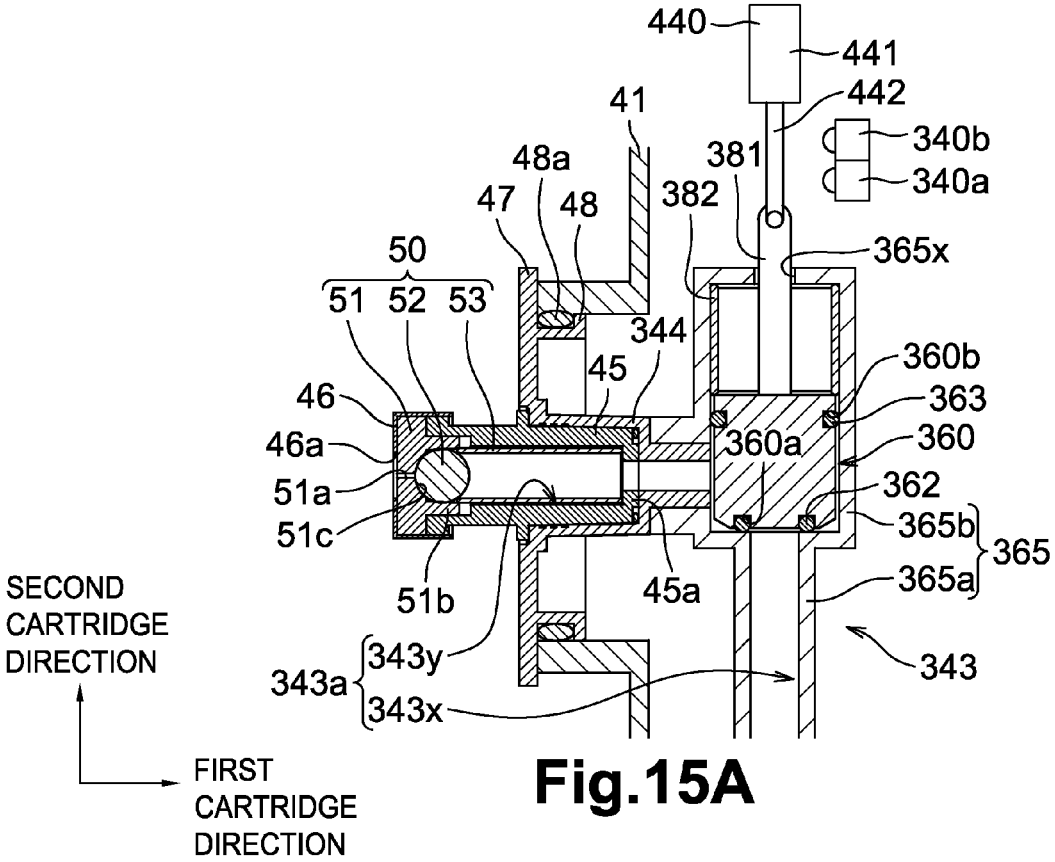
FIG. 15A is a partial cross-sectional view of an ink cartridge according to still another embodiment of the invention, in which each of a first valve and a second valve is in a closed position.
Figure 15B:
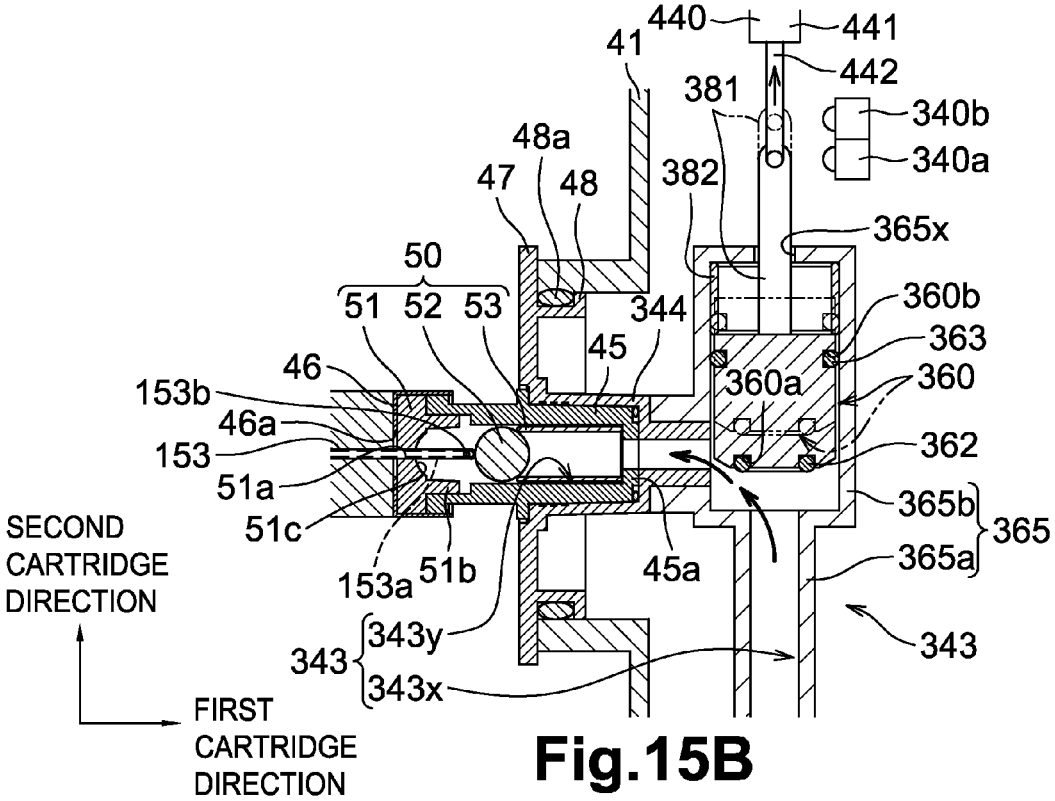
FIG. 15B is a partial cross-sectional view of an ink cartridge according to still another embodiment of the invention, in which each of a first valve and a second valve is in an open position.

FIGS. 15A-15B show still another embodiment of the invention. An ink cartridge according to the still another embodiment has substantially the same structure of the ink cartridge in the yet another embodiment, except that in the still another embodiment, a movable member, e.g., a second valve 360, is not connected to the roller 383, but instead is connected to a solenoid 440. In addition, the through hole 341*x* shown in FIGS. 14A-14B is not formed in a housing 41 because the entering rod 371 does not enter from the printer. Otherwise, like numerals are used for like corresponding parts in the yet another embodiment and the still another embodiment, and a description of those parts is omitted.

Referring to FIG. 15A, the solenoid 440 may comprise a main body 441 and a movable portion 442. The movable portion 442 may project from the main body 441 toward the second valve 360 and may be configured to extend and retract by the control of the controller 100. A tip of the movable portion 442 may be connected to an end of a connecting rod 381. The second valve 360, the connecting rod 381, and the movable portion 442 may be configured to move unitarily in the second cartridge direction, e.g., vertically in FIGS. 15A-15B, as the movable portion extends and retracts. The second valve 360, the connecting rod 381, and the solenoid 440 may function as a solenoid valve.

Similarly to the yet another embodiment, the second valve 360 selectively may transition between a first position shown in FIG. 15A, a second position shown in solid lines in FIG. 15B and a third position shown in broken lines in FIG. 15B. The controller 100 may measure output current values from sensors 340*a* and 340*b* and may determine the position of the second valve 360 based on the output current values, and controls driving of the solenoid 440. In the still another embodiment, the sensors 340*a* and 340*b*, when facing the connecting rod 381, each output a signal representing a relatively high current value. The circumferential surface of the connecting rod 381 may comprise a mirror-like surface configured to reflect light. The movable portion 442 may be disposed offset from the sensors 340*a* and 340*b* in a direction perpendicular to a plane of the sheet of FIGS. 15A-15B, so as not to face the sensors 340*a* and 340*b* in the first cartridge direction.

As described above, the second valve 360 in the yet another and still another embodiments may adjust the amount of ink flowing in the ink outlet path 343*a*, similarly to the second valve 60 in the first described embodiment. Thus, the movement of the second valve 360 is a factor for supplying ink from the reservoir 42 to the head 2. If the sensors 340*a* and 340*b* are inaccurate, there may be an adverse effect on recording operations The controller 100 of the printer in the yet another and still another embodiments may function as an adjuster for adjusting the amount of ink flowing from the reservoir 42 to the head 2, according to the position of the second valve 360 which is determined based on the output current values from the sensors 340*a* and 340*b*. In the yet another and still another embodiments, the second valve 360 selectively takes two open positions and adjusts the amount of ink flowing in the ink outlet path 343*a* to relatively small or large. Consequently, ink may be supplied to the head 2 while the amount of ink flow and the resistance of ink flow are adjusted as required depending on circumstances. For example, the amount of ink flow may be adjusted to relatively large when ink is supplied for the first time upon mounting of the ink cartridge, and may be adjusted to relatively small thereafter, e.g., during recording operations.

Figure 16A:
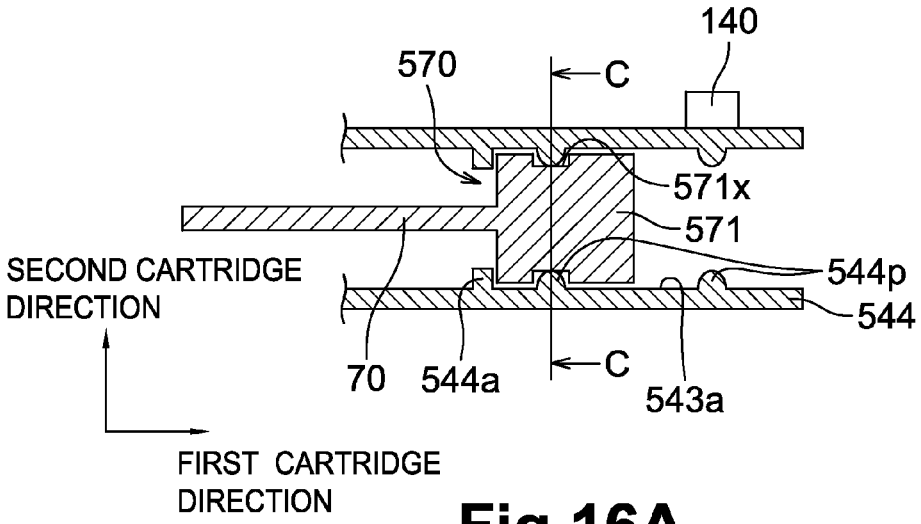
FIG. 16A is a partial cross-sectional view of an ink cartridge according to a still yet another embodiment of the invention, in which a hollow tube has not yet entered the ink cartridge.
Figure 16B:
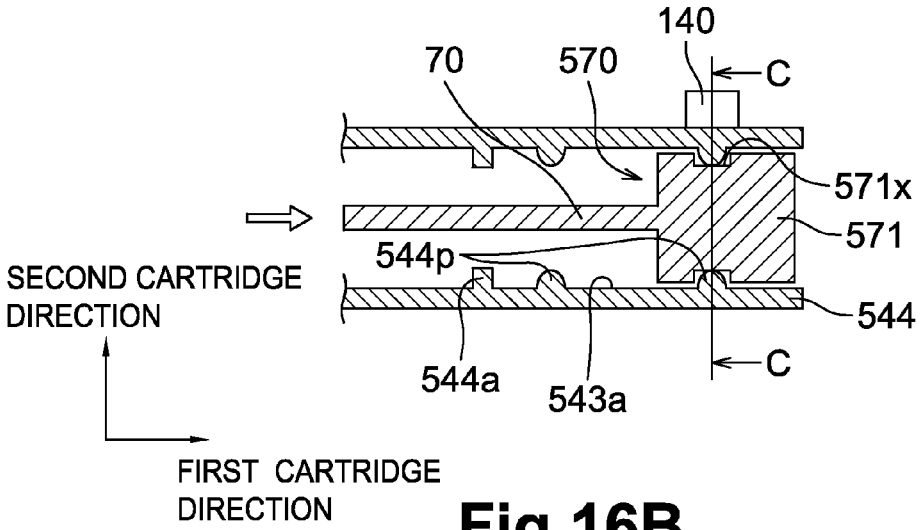
FIG. 16B is a partial cross-sectional view of an ink cartridge according to the still yet another embodiment of the invention, in which the hollow tube has entered the ink cartridge and moved the pressing member.
Figure 16C:
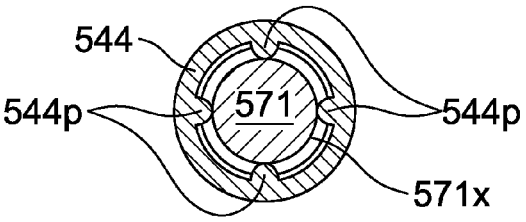
FIG. 16C is a cross-sectional view taken along line C-C of FIGS. 16A and 16B.

FIGS. 16A-16C show a still yet another embodiment of the invention. An ink cartridge in the still yet another embodiment has substantially the same structure of the fluid cartridge 40 in the first described embodiment. Although the fluid cartridge 40 in the first described embodiment comprises the movable member, e.g., the second valve 60, the ink cartridge in the still yet another embodiment comprises a movable member, e.g., an entering member 570, which may be used for detecting a hollow tube 153 entering an ink outlet path 543*a*. Like numerals are used for like corresponding parts in the first and fifth embodiments, and a description of those parts is omitted.

A tube 544 of the still yet another embodiment may differ from the tube 44 in the first described embodiment. Specifically, in the still yet another embodiment, the valve seat 61 may be eliminated and a ring-shaped protrusion 544*a* may not be stepped. Further, protrusions 544*p* may be formed in an inner circumferential surface of the tube 544. As shown in FIG. 16C, four protrusions 544*p* may be formed in each of two positions, e.g., shown by line C-C in FIG. 16A, and by line C-C in FIG. 16B. The two positions may be spaced away from each other in the first cartridge direction. Joint 42*a* and tube 45 are omitted from the drawings in FIGS. 16A-16C, but the joint 42*a* is fitted into one end of the tube 544, and one end of the tube 45 is fitted into the other end of the tube 544, similarly to the tube 44 in the first described embodiment. A platform portion 45*a* of the tube 45 may be contact with a left surface of the ring-shaped protrusion 544*a* shown in FIGS. 16A-16B. An ink outlet path 543*a* may be formed in the tubes 544 and 45 which are connected to each other. The entering member 570 may be disposed in the tube 544.

The entering member 570 may comprise a cylindrical portion 571 and a pressing member 70 which projects from an end face of the cylindrical member 570 toward a first valve 50, similarly to the first described embodiment. The cylindrical portion 571 may have a diameter slightly smaller than the inner diameter of the tube 544, and a gap may be formed between the outer circumferential surface of the cylindrical portion 571 and the inner circumferential surface of the tube 544, to permit ink flow through the gap. The entering member 570 may move from the position shown in FIG. 16A to the position shown in FIG. 16B as the hollow tube 153 enters the ink outlet path 543*a*. The entering member 570 may not prevent ink flow in the ink outlet path 543*a*, regardless of whether the entering member 570 is located in the position of FIG. 16A or FIG. 16B.

The entering member 570 may be locked when the protrusions 544*p* are fitted in an annular recess 571*x* formed in an outer circumferential surface of the cylindrical portion 571. Sectional views of the tube 544 and the entering member 570 shown in FIG. 16C, and taken along line C-C in FIG. 16A and taken along C-C in FIG. 16B are the same.

The entering member 570 may remain locked in the position shown in FIG. 16A until a spherical member 52 of the first valve 50 makes contact with a tip of the pressing member 70 as the hollow tube 153 enters the ink outlet path 543*a*. As the hollow tube 153 enters further inward, the spherical member 52 may contact and press the entering member 570 in a direction shown by an open arrow in FIG. 16B. The entering member 570 may move from the position shown in FIG. 16A and may be locked in the position shown in FIG. 16B. The entering member 570, once locked in the position shown in FIG. 16B, may remain locked there even after the hollow tube 153 is withdrawn from the ink outlet path 543*a*.

A sensor 140 in the still yet another embodiment may be a reflection-detecting type optical sensor comprising a light-emitting portion and a light-receiving portion. The sensor 140 may be disposed in a housing 41, on an outer circumferential surface of the tube 544 at a position opposed to one of the protrusions 544*p*, which may be positioned farther from the first valve 50 than the other of the protrusions 544*p*, e.g., which may be further to the right as shown in FIG. 16A than the other of the protrusions 544*p*. The circumferential surface of the entering member 570 comprises a mirror-like surface configured to reflect light. In a state shown in FIG. 16A, light emitted from the light-emitting portion of the sensor 140 may not be reflected at the circumferential surface of the entering member 570, and the light-receiving portion receives no reflected light and outputs a signal representing a relatively low current value. In a state shown in FIG. 16B, light emitted from the light-emitting portion of the sensor 140 may be reflected at the circumferential surface of the entering member 570, and the light-receiving portion may receive the reflected light and outputs a signal representing a relatively high current value. The controller 100 of the printer thus may determine the position of the entering member 570 based on the output current value from the sensor 140.

As described above, in the still yet another embodiment, the position of the entering member 570 may be used to determine whether the hollow tube 153 enters the ink outlet path 543*a* Accordingly, a printer failure may be prevented by notifying an error and by stopping operations of the printer when the hollow tube 153 does not enter the ink outlet path 543*a* properly. Moreover, this detection may still function properly when a sensor for detecting the first valve 50 becomes faulty, because the position of the first valve 50 may be determined from the detection results of the entering member 570.

Figure 17A:
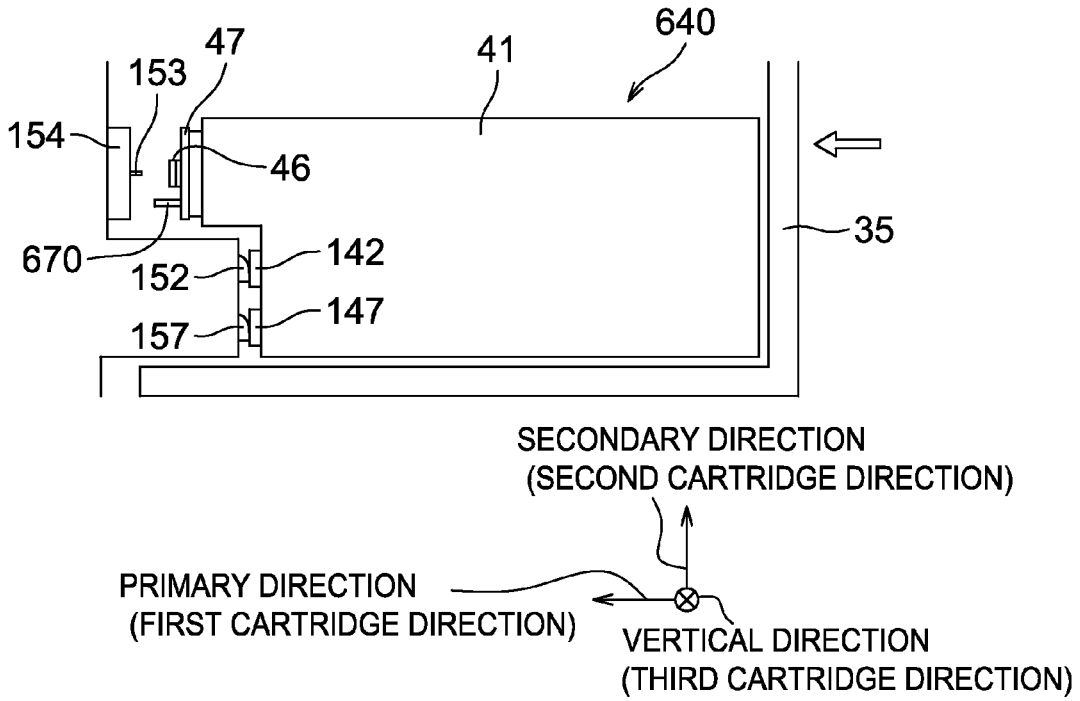
FIGS. 17A and 17B are partial plan views showing an ink cartridge which is being mounted to an ink jet printer, according to a further embodiment of the invention.
Figure 17B:
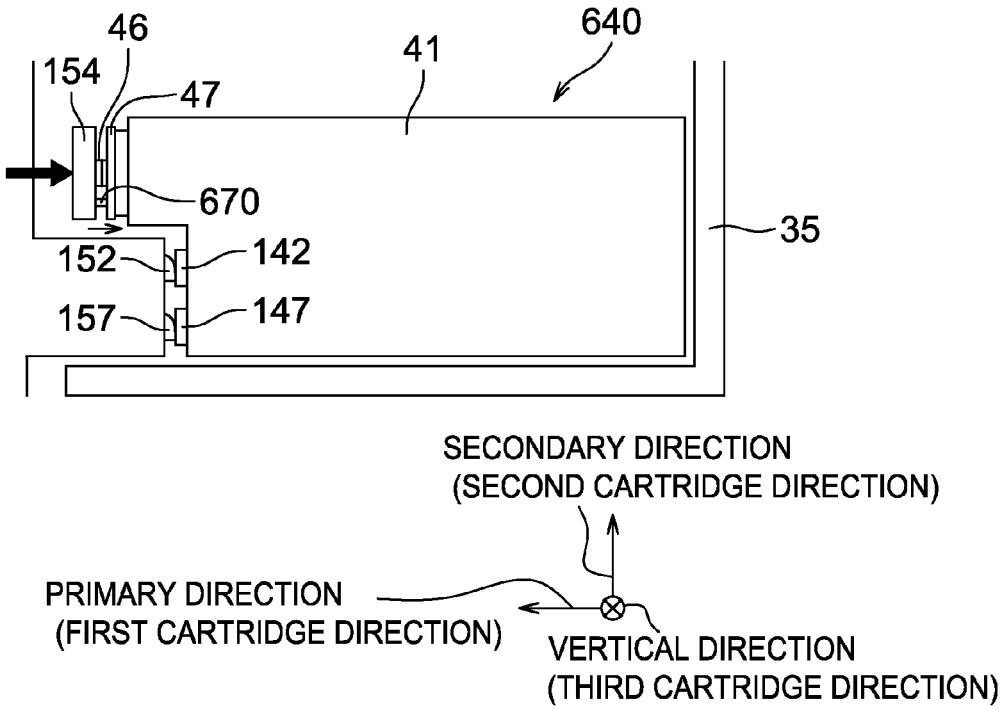

FIGS. 17A-17B describe a further embodiment of the invention. The further embodiment is similar to the first described embodiment, with the addition of a movable member, e.g., an entering member 670, to the fluid cartridge 40, to detect the entrance of a hollow tube 153 into an ink outlet path 43*a*. Like numerals are used for like corresponding parts in the first and sixth embodiments, and a description of those parts is omitted. The entering member 670 may be a rodlike member extending in the first cartridge direction and may be inserted into a flange 47. A tip of the entering member 670 may be located outer than a cap 46. When the hollow tube 153 moves together with a base portion 154 toward an ink cartridge 640, e.g., in a direction shown by a bold arrow in FIG. 17B, a surface of the base portion 154 may make contact with the tip of the entering member 670. The entering member 670 thus may be pressed by the base portion 154 and may retract toward the housing 41 of the ink cartridge 640 in a direction shown by a thin arrow in FIG. 17B. The entering member 670 then moves outside the ink outlet path 43*a* but not inside the ink outlet path 43*a*.

The ink cartridge 640 in the further embodiment also comprises a sensor (not shown) for detecting the entering member 670. The controller 100 of the printer may determine whether or not the hollow tube 153 enters the ink outlet path 43*a* by determining the position of the entering member 670 based on the output current value from the sensor.

Figure 18A:
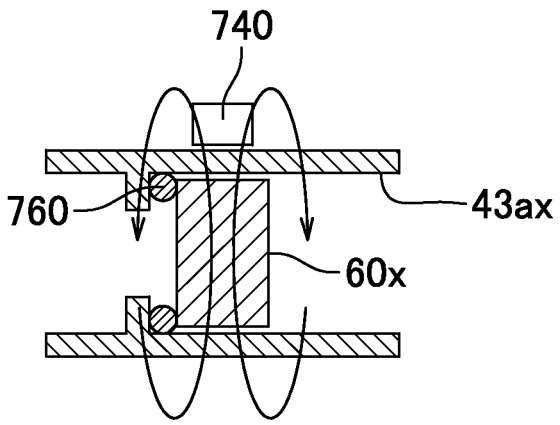
FIGS. 18A and 18B are schematic views of a magnetic sensor to be applied to an ink cartridge according to a yet further embodiment of the invention.
Figure 18B:
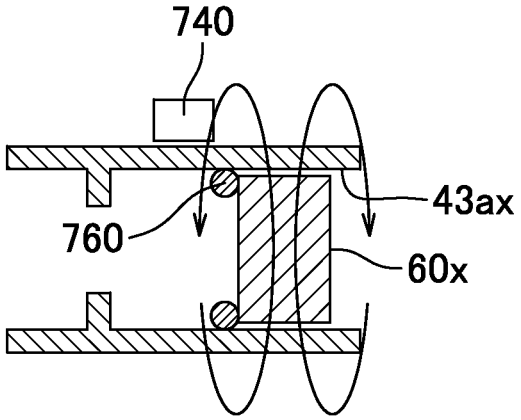
Figure 24:
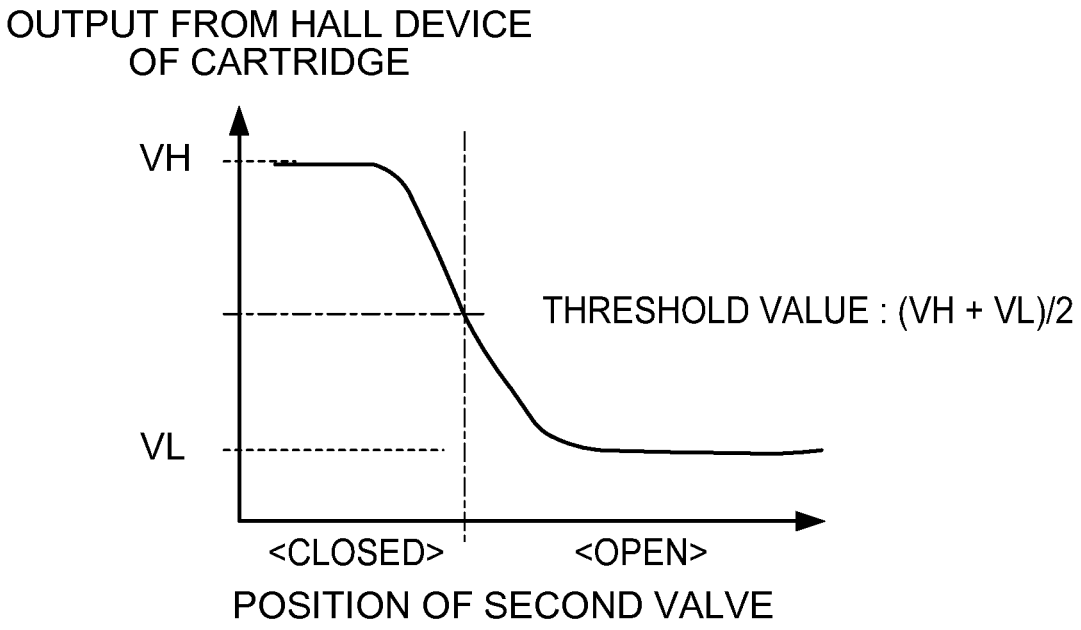
FIG. 24 is a graph showing the relation between the position of the second valve and the output from hall device of the ink cartridge, according to the yet further embodiment of the invention.

FIGS. 18A, 18B and 24 show a yet further embodiment of the invention. An ink cartridge in the yet further embodiment may have substantially the same structure as the fluid cartridge 40 in the first described embodiment, except that the optical sensor 140 in the first described embodiment is replaced with a magnetic sensor 740. A second valve 60*x* and an ink outlet path 43*a* in FIG. 18 are shown by simplifying the second valve 60 and the ink outlet path 43*a* in the first embodiment.

The magnetic sensor 740 may comprise a Hall element and may be actuated by a predetermined power supply voltage Vcc supplied from the printer 1. The magnetic sensor 40 may output a signal representing a voltage value which is proportional to a magnetic flux density shown in FIG. 24. The magnetic density may vary depending on a distance from the second valve 60*x* comprising a permanent magnet. When the second valve 60*x* is in the closed position, as shown in FIG. 18A, the magnetic flux density detected by the magnetic sensor 740 may be relatively high, and the magnetic sensor 740 may output a signal representing a relatively high voltage value VH. When the second valve 60*x* is in the open position, as shown in FIG. 18B, the magnetic flux density detected by the magnetic sensor 740 may be relatively low, and the magnetic sensor 740 may output a signal representing a relatively low voltage value VL. A memory 141 of the ink cartridge stores, as output value data, the relatively high voltage value VH measured when the second valve is in the closed position and the relatively low voltage VL measured when the second valve is in the open position.

When the ink cartridge comprising the magnetic sensor 740 is mounted to the printer 1, the controller 100 controls the printer 1 in a similar manner to that shown in FIG. 7 except for the following steps. When the ink cartridge is mounted to the printer 1, the predetermined power supply voltage Vcc is supplied to the magnetic sensor 740. In Step S4, the controller 100 sets a threshold value to (VH+VL)/2 based on the voltage values VH and VL retrieved in Step S2. Consequently, the controller 100 skips the step of setting of an input value in Step S5, and measures an output voltage value from the magnetic sensor 740 in Step S7. The controller 100 also determines whether the output voltage value is less than the threshold value in Step S8.

Prior to Step S6 in which the hollow tube 153 is started moving, the controller 100 may measure an output voltage value from the magnetic sensor 740 and determine whether the output voltage value is not less than the threshold value. A determination that the output voltage value is less than the threshold value indicates that the second valve 60 is not in the closed position even before the hollow tube 153 is stated moving. In this case, because there is a possibility that the second valve 60 or the magnetic sensor 740 is broken, the controller 100 may notify an error, and may stop operations of each component of the printer 1 to disable recording operations, similarly to as described above.

In Step S8 of the yet further embodiment, a determination regarding whether the output voltage value is less than the threshold value in Step S8 may be replaced with a determination as to whether the output voltage value is less than the threshold value and not less than a first predetermined value. The determination regarding whether the output voltage value is less than the threshold value, prior to the start of moving of the hollow tube in Step S6, also may be replaced with a determination regarding whether the output voltage is less than the threshold value and not less than a second predetermined value. The first predetermined value and the second predetermined value may be stored in the controller 100 upon manufacture of the printer 1, or may be written in a memory 141 of the ink cartridge together with the voltage values VH and VL and retrieved by the controller 100 from the memory 141 in S2. Alternatively, the memory 141 may store, as the output value data, the voltage value VH only or the voltage value VL only.

When the memory 141 stores, as the output value data, the voltage value VH only, the controller 100 may, in Step S6, measure the output voltage value from the magnetic sensor 740 before the hollow tube is started moving. The controller 100 determines that the second valve 60 is in the closed position when the measured output voltage value is within a predetermined range plus or minus the voltage value VH retrieved in Step S2.

When the memory 141 stores, as the output value data, the voltage value VL only, the controller 100 may determine, in Step S8 that the second valve 60 is in the open position when the output voltage value measured is within a predetermined range, plus or minus the voltage value VL retrieved in Step S2.

A method for manufacturing the ink cartridge of the yet further embodiment will now be described. Similarly to as described above, steps for manufacturing the ink cartridge may be executed by either a manufacturing device or a worker. In this embodiment, all the steps are executed by a manufacturing device that comprises an injector, a controller, and a display.

First, all parts of the ink cartridge, e.g., a housing, reservoir 42, ink outlet tube 42, first valve 50, second valve 60*x*, cap 46, sensor 740, memory 141, and contact 142, are assembled to each other. Specifically, the reservoir 42, ink outlet tube 43, first valve 50, second valve 60*x*, sensor 740, etc. are assembled into the housing 41.

Subsequently, the ink injector may inject ink into the reservoir 42. Ink may be injected when the second valve 60*x* is transitioned from the closed position to the open position, e.g., by inserting a pressing bar of the injector from the other end of the tube 45 into the tube 45, to press the valve body 62 against the biasing force of the coil spring 63. When the pressing bar is withdrawn from the other end of the tube 45 after ink injection is completed, the second valve 60*x* is shifted from the open position to the closed position by the biasing force of the coil spring 63.

Subsequently, while the manufacturing device maintains the second valve 60*x* in the closed position, the controller of the manufacturing device may cause a power supply voltage Vcc, which is equal to the power supply voltage to be supplied from the printer 1, to be supplied to the magnetic sensor 740 and measures an output voltage value from the magnetic sensor 740. The controller then may write the measured output voltage value VH in the memory 141.

Subsequently, the manufacturing device may transition the second valve 60*x* from the closed position to the open position, e.g., by inserting the pressing bar of the injector from the other end of the tube 45 into the tube 45, as described above, so as to press the valve body 62 against the biasing force of the coil spring 63. While the manufacturing device maintains the second valve 60*x* in a predetermined open position, the controller of the manufacturing device may cause the power supply voltage Vcc, which is equal to the power supply voltage to be supplied from the printer 1, to be supplied to the magnetic sensor 740 and measures an output voltage value from the magnetic sensor 740. The controller may write the measured output voltage value VL in the memory 141. The controller further may write, in the memory 141, the date of writing data, e.g., the writing date, the valid use limit of the characteristic information, and the manufacture date of the fluid cartridge 40. In this way, manufacturing of the ink cartridge is completed.

Alternatively, when the power supply voltage to be supplied from the printer 1 to which the ink cartridge of the yet further embodiment is mounted is adjustable by the controller 100, the memory 141 may store, in addition to the output voltage values VH and VL, such a power supply voltage value that causes the output voltage value from the magnetic sensor 740 to become the voltage value VH when the second valve is in the closed position and to become the voltage value VL when the second valve is in the open position.

In this embodiment, when the ink cartridge is mounted to the printer 1, the controller 100 controls the printer 1 in a similar manner to that shown in FIG. 7 except for the following steps. The controller 100 may set, in Step S4, the threshold value to be (VH+VL)/2 based on the output voltage values VH and VL retrieved in Step S2. Then, instead of setting the input current value in Step S5, the controller 100 may adjust the power supply voltage to become the power supply voltage retrieved in Step S2, and may supply the adjusted power supply voltage to the magnetic sensor 740. Then, the controller 100 may measure the output voltage from the magnetic sensor 740 in Step S7, and may determine whether the output voltage is less than the threshold value in Step S8.

Alternatively, the memory 41 may not store the output voltage values VH and VL, and may store the power supply voltage value only. In this embodiment, the output voltage values VH and VL are stored previously in the controller 100 at the time of manufacture of the printer 1. Because the controller does not retrieve the output voltage values VH and VL in Step S2, then in Step S4, controller 100 sets the threshold value to be (VH+VL)/2 based on the output voltage values VH and VL stored in the controller 100.

A method for manufacturing the above-described ink cartridge, which is to be mounted to the printer whose power supply voltage is adjustable, will be described.

While maintaining the second valve 60*x* in the closed position, a controller of a manufacturing device gradually may increase a power supply voltage to the magnetic sensor 740 and may measure the power supply voltage when the output voltage value from the magnetic sensor 740 becomes a predetermined value VH. The controller may write, in the memory 141, the output voltage value VH and the measured power supply voltage.

Subsequently, the manufacturing device may transition the second valve 60*x* from the closed position to the open position. While maintaining the second valve 60*x* in a predetermined open position, the controller may supply the measured power supply voltage to the magnetic sensor 740 and may measure the output voltage value from the magnetic sensor 740. The controller then may write the measured output voltage value in the memory 141. Thus, manufacturing of the liquid cartridge according to the above-described embodiments may be completed.

Figure 19:
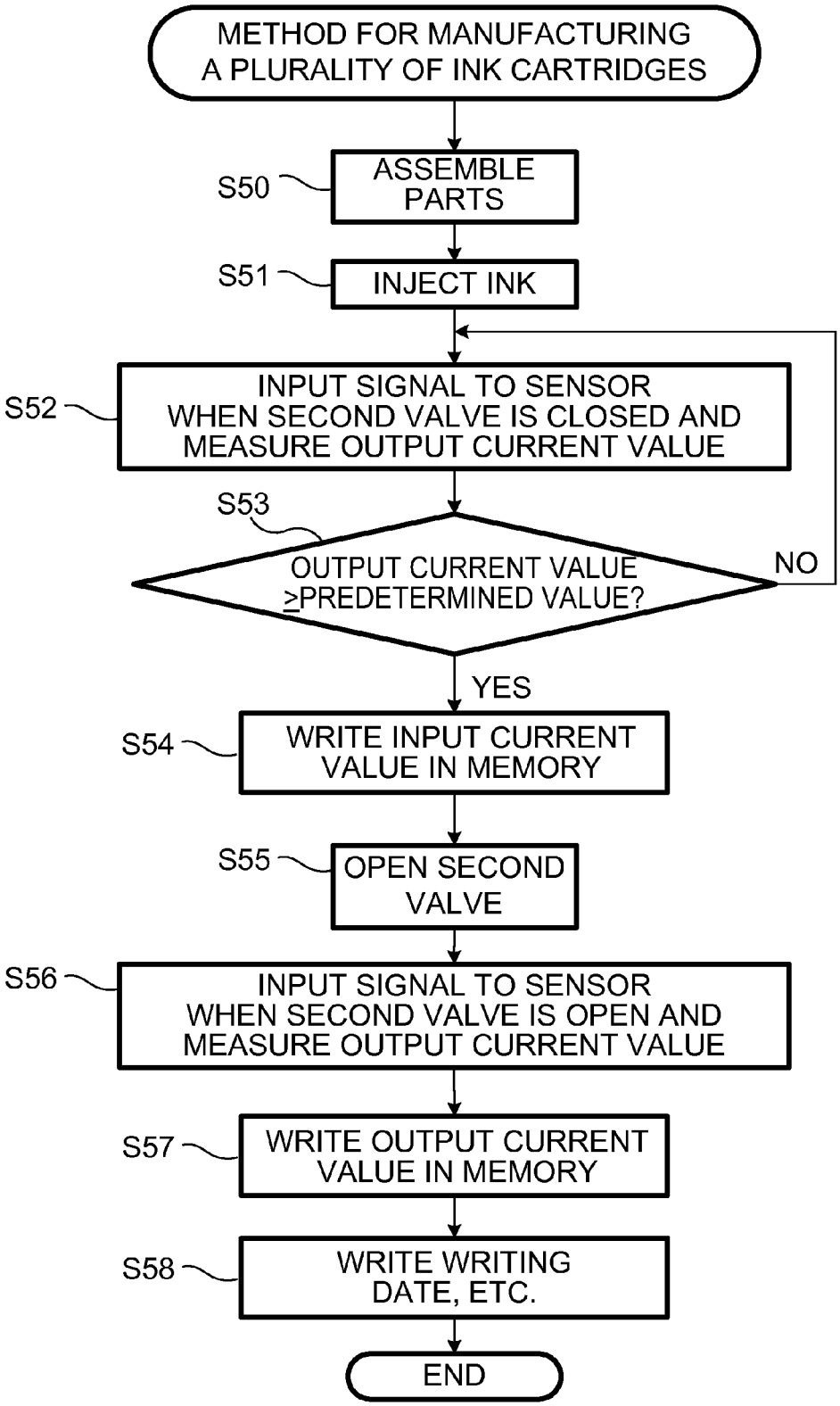
FIG. 19 is a flowchart showing a method for manufacturing ink cartridges in units of a plurality of ink cartridges, according to a still further embodiment of the invention.
Figure 20:
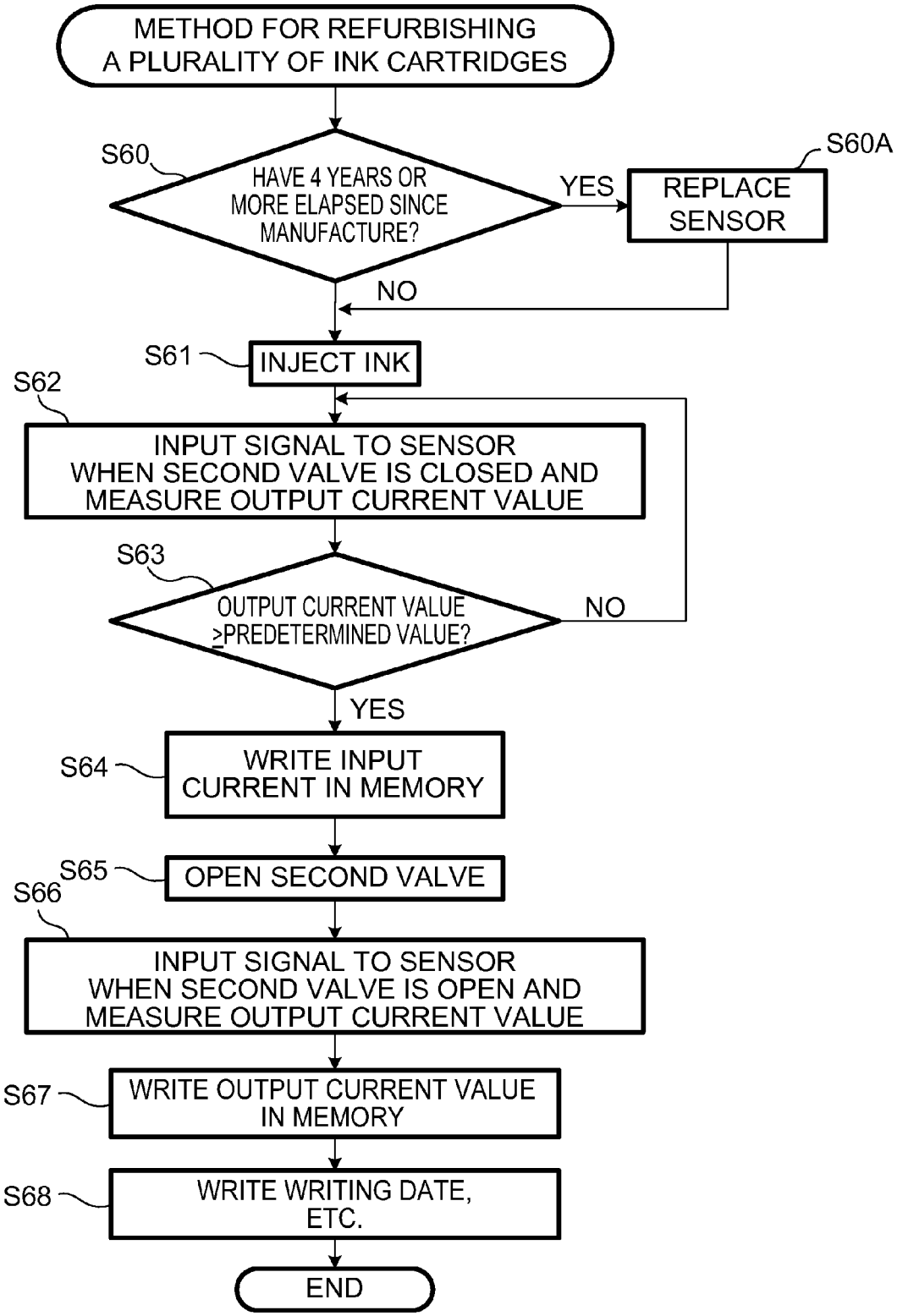
FIG. 20 is a flowchart showing a method for refurbishing ink cartridges in units of a plurality of ink cartridges, according to the still further embodiment of the invention.

FIGS. 19 and 20 describe a still further embodiment of the invention in which the liquid cartridges are manufactured or refurbished not individually, but collectively in units of a plurality of liquid cartridges. In the still further embodiment, the method for manufacturing a plurality of ink cartridges may comprise a series of steps, shown in FIG. 19, which are executed for each of the plurality of ink cartridges. Steps S50-S52 and S55-S58 are substantially the same as Steps S20-S22 and S25-S28 shown in FIG. 10, respectively, but Steps S53 and S54 are different from the Steps S23 and S24 shown in FIG. 10 and described in conjunction with the first described embodiment. Thus, only Steps S53 and S54 will be described in detail herein.

A controller of a manufacturing device gradually may increase an input current value in Step S52. When an output current value from a sensor 140 becomes equal to or greater than a predetermined value, i.e., predetermined output current value ICmax, e.g., "YES" at Step S53, then in Step S54, the controller may write a corresponding input current value in a memory 141. The predetermined value may be commonly used for a plurality of sensors of a plurality of ink cartridges to be manufactured by this manufacturing method. Thus, in Step S56, the input current value written in the memory 141 in Step S54 is used.

In the still further embodiment, the method for refurbishing a plurality of ink cartridges may comprise a series of steps, shown in FIG. 20, which may be executed for each of the plurality of ink cartridges. Steps S60-S62 and S65-S68 are substantially the same as Steps S30-S32 and S35-S38 shown in FIG. 11, but Steps S63 and S64 are different from the Steps S33 and S34 shown in FIG. 11 and described in conjunction with the first described embodiment, respectively. Specifically, Steps S63 and S64 are the same as Steps S53 and S54 of the above-described manufacturing method, respectively.

In the first described embodiment, the input current value which, when input to the sensor 140 of the fluid cartridge 40, causes the output current value from the sensor 140 to be saturated may be written individually in the memory 141 of the fluid cartridge 40. In contrast, in the still further embodiment, the input current value which, when input to each one of the sensors 140 of the plurality of ink cartridges, causes the output current value from the sensor 140 to be equal to or greater than the predetermined value, is written commonly in the memories 141 of the plurality of ink cartridges. This may increase efficiency in manufacturing or refurbishing ink cartridges.

The controller 100 of the printer 1 to which an ink cartridge manufactured or refurbished by the method of the still further embodiment is mounted sets, in Step S5 of FIG. 7, the input current value is retrieved, in Step S2, from the memory 141 of the ink cartridge, which input current value was written in the memory 141 in Step S54 or S64 as described above. The retrieved input current value may be used as the input current value for detection. The input current value for detection may be represented by a signal input from the controller 100 to the sensor 140 for detection of a movable member. The controller 100 may set the threshold value in Step S4 of FIG. 7, based on the predetermined output current value ICmax used in Steps S53 or S63, and the output current value ICmin written in Steps S57 or S67. The predetermined output current value ICmax may be stored previously in the controller 100 upon manufacture of the printer 1, or may be written in the memory 141 together with the input current value in Steps S54 or S64 and retrieved by the controller 100 in Step S2. Alternatively, the memory 141 may store the input current value only. In this case, before the controller 100 starts moving the hollow tube in Step S6, the controller 100 may input the input current value retrieved from the memory 141 in Step S2 to the sensor 140, and may measure the output current value from the sensor 140. The controller 100 may determine that the second valve 60 is in the closed position when the measured output current value is within a predetermined range plus or minus the predetermined output current valued ICmax which is stored previously in the controller 100 upon manufacture of the printer 1.

Figure 21:
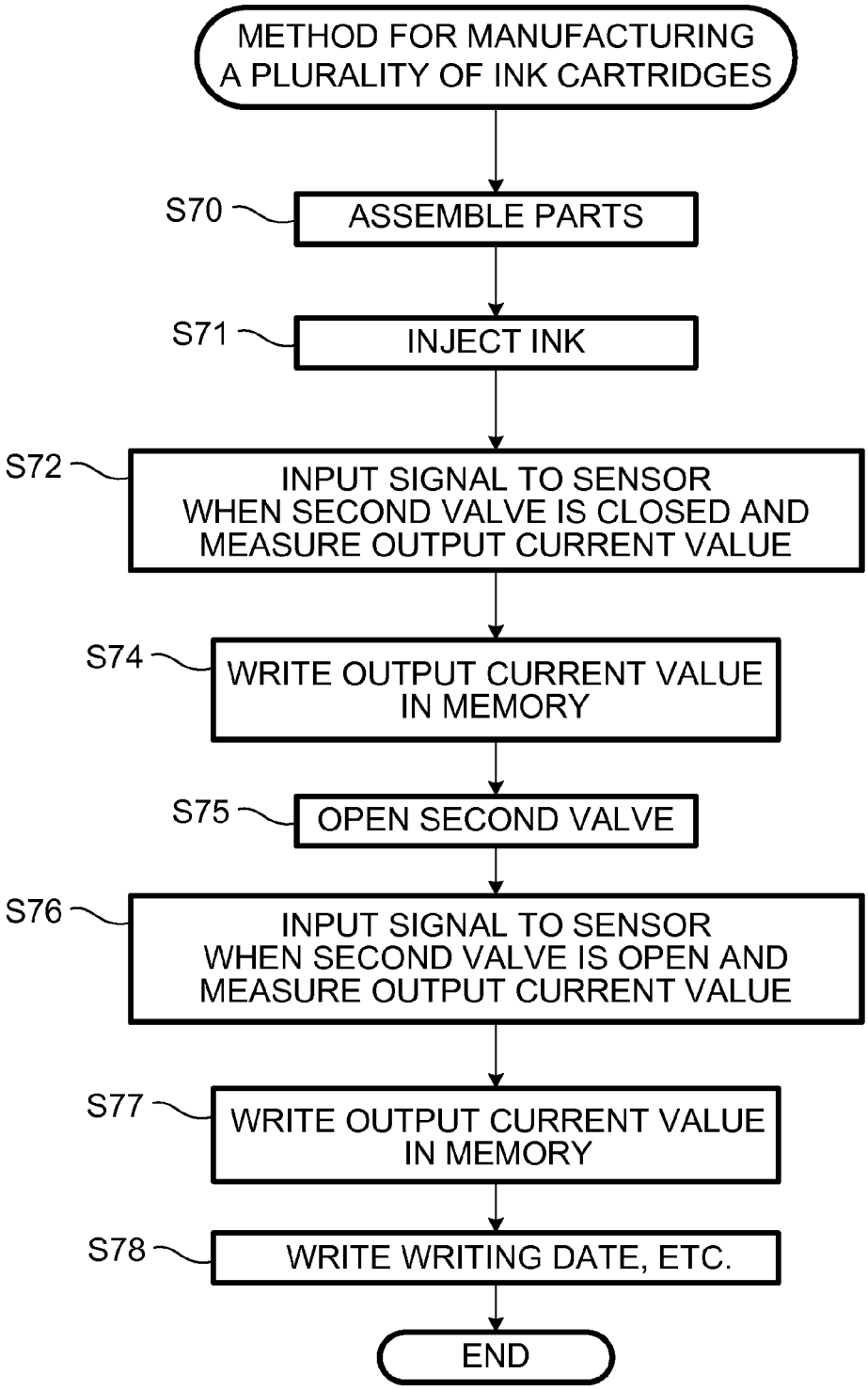
FIG. 21 is a flowchart showing a method for manufacturing ink cartridges in units of a plurality of ink cartridges, according to a still yet further embodiment of the invention.
Figure 22:
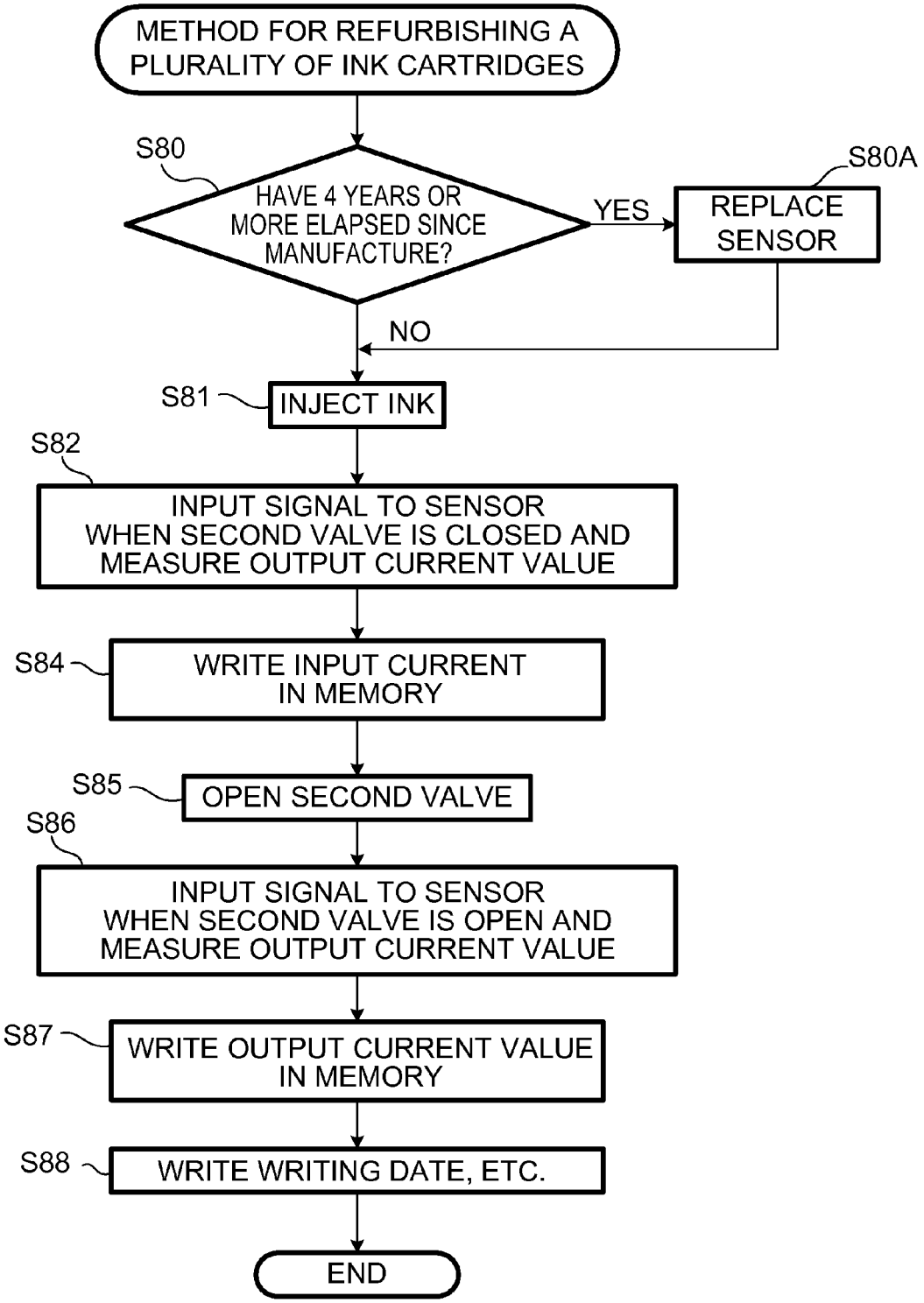
FIG. 22 is a flowchart showing a method for refurbishing ink cartridges in units of a plurality of ink cartridges, according to the still yet further embodiment of the invention.

FIGS. 21 and 22 describe a still yet further embodiment of the invention. In still yet further embodiment, ink cartridges are manufactured or refurbished not individually but correctively in units of a plurality of ink cartridges, similarly to the still further embodiment. In the still yet further embodiment, the method for manufacturing a plurality of ink cartridges may comprise a series of steps, shown in FIG. 21, which may be executed for each of the plurality of ink cartridges. Steps S70-S78 may be substantially the same as Steps S20-S28 shown in FIG. 10, but Step S23 is eliminated, and Steps S72, S74 and S76 are different from Steps S22, S24, and S26 shown in FIG. 10 and described in conjunction with the first described embodiment, respectively. Only those steps different from those in the first described embodiment will be described in detail herein.

In Step S72, a controller of a manufacturing device may input a signal representing a predetermined input current value to a sensor 140, and may write a corresponding output current value from the sensor 140 in a memory 141 in Step S74. The predetermined input current value may be commonly used for a plurality of sensors of the plurality of ink cartridges to be manufactured by this manufacturing method. In Step S76, the same input current value as that used in S72 is used.

In the still yet further embodiment, the method for refurbishing a plurality of ink cartridges comprises a series of steps, shown in FIG. 22, which may be executed for each of the plurality of ink cartridges. Steps S80-S88 may be substantially the same as Steps S30 to S38 as shown in FIG. 11 in the first described embodiment, respectively, but Step S33 is eliminated, and Steps S82, S84 and S86 are different from Steps S32, S34 and S36 in the first embodiment, respectively. Specifically, Steps S82, S84, and S86 are the same as S72, S74, and S76 of the above-described manufacturing method, respectively.

As described above, in the still yet further embodiment, the predetermined input current value which is common to a plurality of sensors may be used in Steps S74 and S84. This may increase efficiency in manufacturing or refurbishing ink cartridges.

The controller 100 of the printer 1 to which an ink cartridge manufactured or refurbished by the method of the ninth embodiment is mounted may set the threshold value in Step S4 of FIG. 7, based on the output current values retrieved from the memory 141 in Step S2, i.e., the output current value ICmax written in Steps S74 or S84, and the output current value ICmin written in Steps S77 or S87. The controller 100 may set the predetermined input current value used in Steps S72 or S82, as the input current value for detection in Step S5. The predetermined input current value may be stored in the controller 100 upon manufacture of the printer 1, or may be written in the memory 141 together with the output current value in Steps S74 or S84 and retrieved by the controller 100 in Step S2.

Figure 23A:
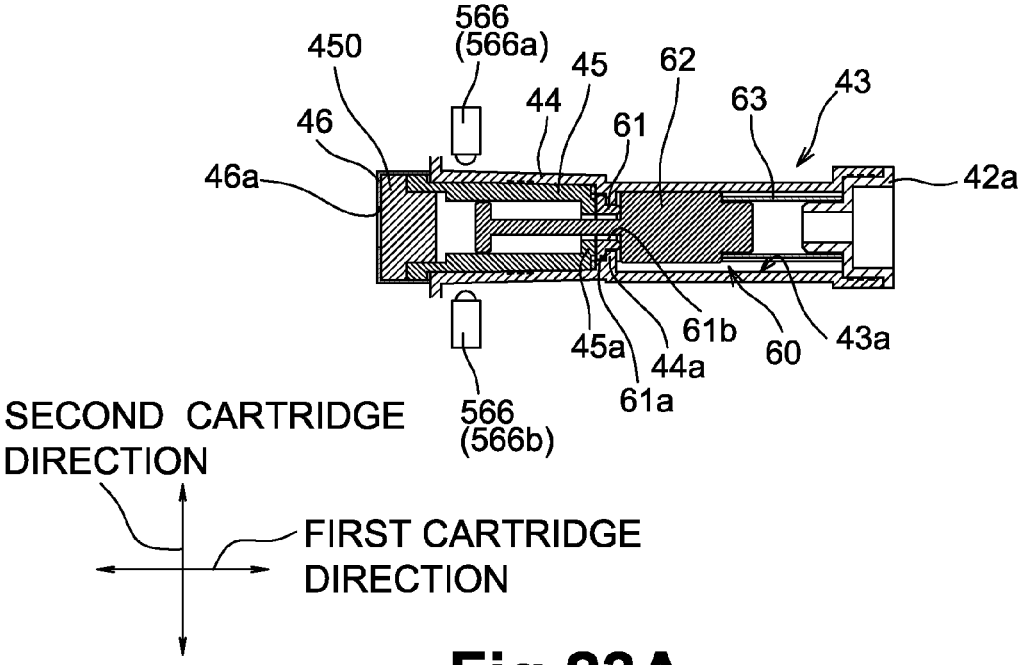
FIG. 23A and FIG. 23B are partial cross-sectional views of an ink cartridge according to a still yet another further embodiment of the invention, in which each of a first valve and a second valve is in a closed position in FIG. 23A, and each of the first valve and the second valve is in an open position in FIG. 23B.
Figure 23B:
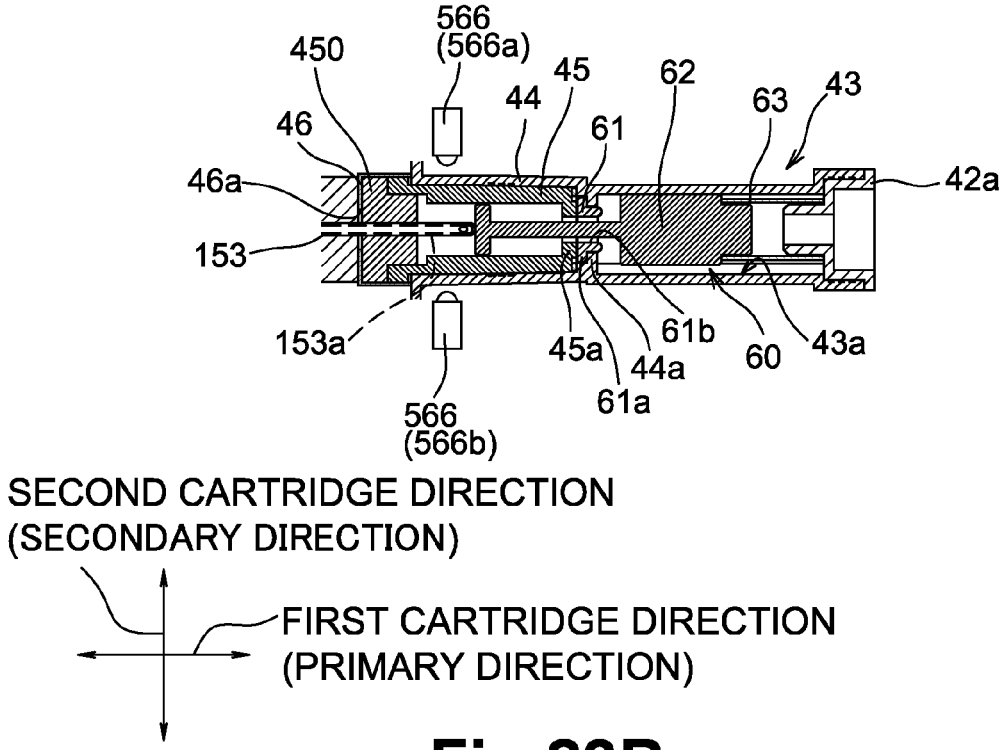

FIGS. 23A and 23B show a still yet another further embodiment of the invention. An ink cartridge in the still yet another further embodiment may have substantially the same structure of the ink cartridge 40 in the first embodiment, but the first valve 50 and the sensor 140 in the previously described embodiments may be structured differently in the embodiment described herein. Only those structures that are different from those in the first embodiment will be described.

In the above-described embodiments, the photo sensor 140 may be configured to indirectly detect that the hollow tube 153 is at a predetermined range of positions within the ink outlet path 43*a* by detecting that the movable member (pressing member 70 and valve body 62) is positioned at a predetermined range of positions. Nevertheless, referring to FIGS. 23A and 23B, according to the still yet another further embodiment, a photo sensor 566 may be configured to directly detect that the hollow tube 153 is at a predetermined range of positions within the ink outlet path 43*a*. The photo sensor 566 may be a light-transmission-detecting type optical sensor comprising a light-emitting portion 566*a* and a light-receiving portion 566*b* facing each other via the ink outlet tube 43. The photo sensor 566 may be configured to detect a presence of, and a position of an object within the ink outlet path 43*a*. Specifically, the photo sensor 566 may detect whether the hollow tube 153 is positioned within a predetermined range of positions within the ink outlet path 43*a*.

Referring to FIG. 23A, when the hollow tube 153 is not inserted into a sealing member 450, light emitted from the light-emitting portion 566*a* may pass through the ink outlet path 43*a* and reach the light-receiving portion 566*b*. Therefore, the amount of light received at the light-receiving portion 566*b* may be relatively large, and the photo sensor 566 may outputs a relatively high output current value, e.g., a further value. Referring to FIG. 23B, when the hollow tube 153 is inserted into the sealing member 51 and reaches a position in the ink outlet path 43*a* between the light-emitting portion 566*a* and the light-receiving portion 566*b*, light emitted from the light-emitting portion 566*a* may be at least partially blocked by the hollow tube 153. Therefore, the amount of light received at the light-receiving portion 566*b* may be less than the amount received when the hollow tube is positioned as shown in FIG. 23A, and the photo sensor 566 outputs a relatively small output current value compared to when the hollow tube 153 is not disposed within the ink outlet path 43*a*. This relatively small output current value may be a particular value indicating that the reservoir 42 and the outside of the fluid cartridge 40 are in fluid communication.

Thus, in an embodiment of the invention, the sensor outputs the particular data corresponding to the particular value when the sealing member is penetrated. In another embodiment of the invention, the sensor outputs the particular data corresponding to the particular value when an object other than the ink, e.g., the hollow tube 153, is disposed in the ink outlet path 43*a*. In this case, in Step S4, the determination by the controller 100 does not correspond to the determination of whether or not the second valve 60 is in the open position, but corresponds to the determination of whether or not the hollow tube 153 has been correctly inserted into the ink cartridge.

In the still yet another further embodiment, for example, if the hollow tube 153 is broken off from its base portion, the hollow tube 153 may not be able to be inserted into the sealing member 450 when the ink cartridge is mounted to the printer 1, and therefore the sealing member 450 may not be placed in the open position. When this occurs, ink may not be supplied to the ink jet head 2 when printing is performed, and printing failure may occur. In such a case, however, it is determined that the hollow tube 153 has not been properly inserted into the ink outlet path 43*a*, and at Step S11, the error is notified. Hence, the printing failure may be avoided.

Similarly, if the tip of the hollow tube 153 is broken off, the broken tip of the hollow tube 153 may damage the sealing member 450 when the ink cartridge 40 is mounted to the printer 1. In such a case, ink may leak from the damaged sealing member 51. In such a case, however, it is determined that the hollow tube 153 has not been properly inserted into the ink outlet path 43*a*, at Step S11, the error is notified. Accordingly, a user may notice that the hollow tube 153 is broken, and therefore ink leakage due to the broken hollow tube 153 may be avoided.

Alternatively, the photo sensor 566 may be replaced with a magnetic sensor. In this case, the light-emitting portion 566*a* is replaced with a Hall element, and the light-receiving portion 566*b* is replaced with a permanent magnet. In this modification, the hollow tube 153 may comprise a magnetic material. In this modification, similarly to as described above, the sensor outputs the particular data corresponding to the particular value when the sealing member is penetrated. In another embodiment of the invention, the sensor outputs the particular data corresponding to the particular value when an object other than the ink, e.g., the hollow tube 153, is disposed in the ink outlet path 43*a*.

Figure 25:
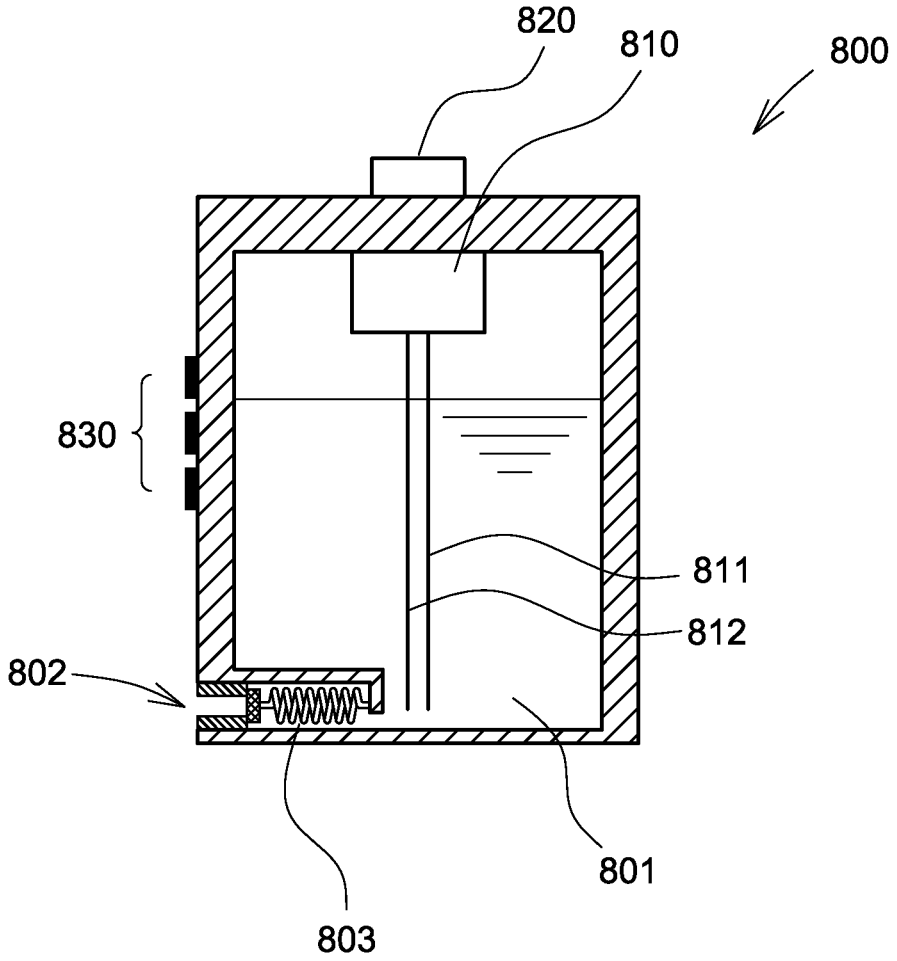
FIG. 25 is a general sketch of an ink cartridge according to an eleventh embodiment of the invention.
Figure 26:
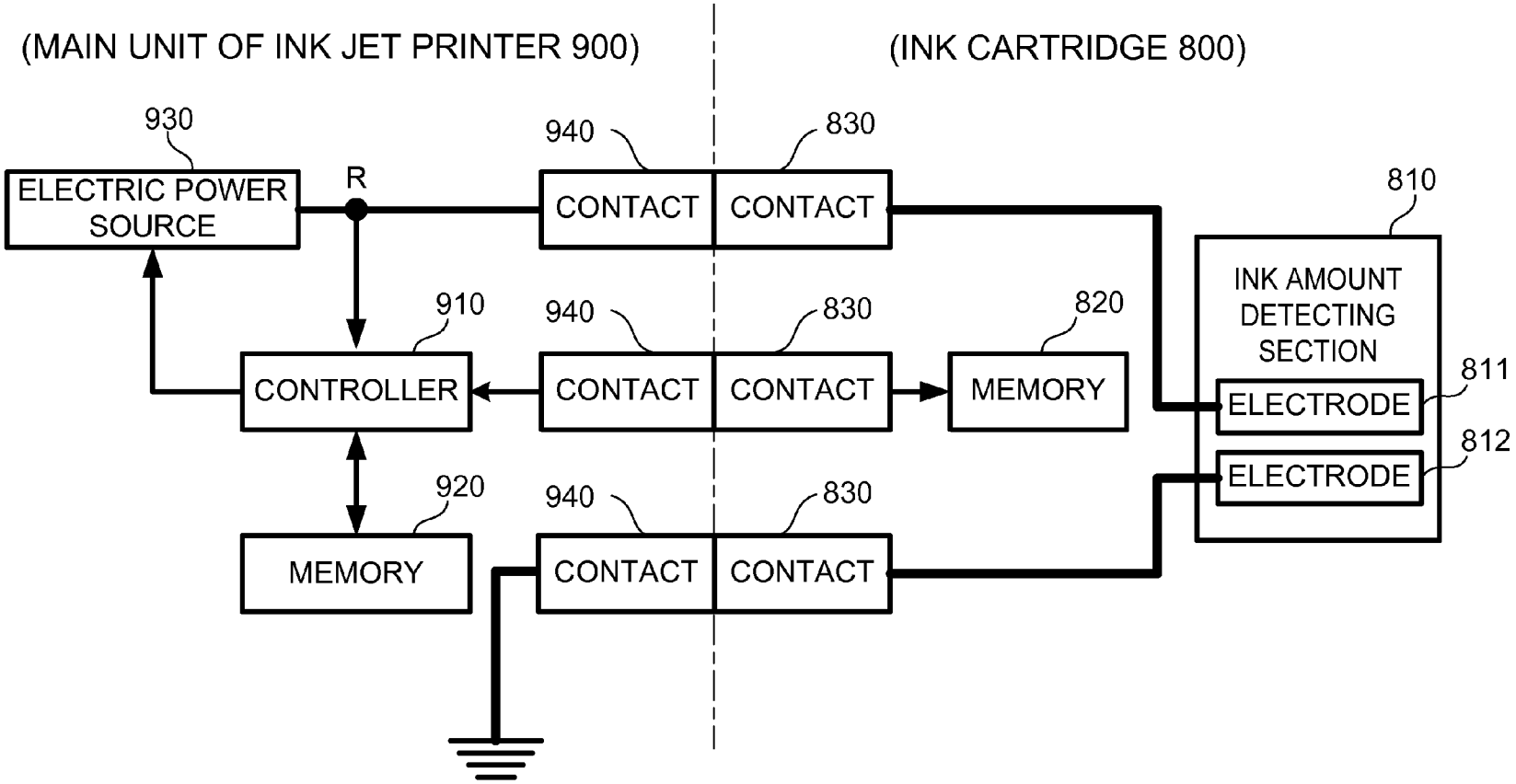
FIG. 26 is a block diagram showing an electrical configuration of the ink cartridge and an ink jet printer according to the eleventh embodiment of the invention.

Referring to FIGS. 25 and 26, an eleventh embodiment in which the present invention is applied to a sensor for detecting the remaining amount of ink in an ink cartridge will be described.

An ink cartridge 800 includes an ink storing portion 801 to store ink, an ink outlet port 802 for discharging the ink stored in the storing portion 801 to the outside of the ink cartridge 800, a valve 803 to open and close the ink outlet port 802, a remaining ink amount sensor 810 to detect the remaining amount of the ink stored in the ink storing portion 801, a memory 820 to store information about the ink cartridge 800, and a plurality of terminals 830 to be connected to a plurality of terminals 940 of a main unit 900 of an ink jet printer when the ink cartridge 800 is mounted to the main unit 900.

The main unit 900 of the ink jet printer includes a controller 910, a memory 920, a power supply 930, and the plurality of terminals 940.

The remaining ink amount sensor 810 includes a pair of electrodes 811 and 812. These electrodes 811 and 812 extend in a direction of gravity when the ink cartridge 800 is mounted to the main unit 900 of the ink jet printer.

When the ink cartridge 800 is mounted to the main unit 900, one of the electrodes 811 is connected to the power supply 930 and the other electrode 812 is grounded. The power supply 930 supplies a predetermined constant current Ic across the electrodes 811 and 812. When the constant current Ic is supplied across the electrodes 811 and 812, a controller 910 measures a voltage value at a point (at point R in FIG. 26) in a line wiring between the power supply 930 and one of the terminals 940.

The memory 820 of the ink cartridge 800 previously stores therein a voltage value obtained when the predetermined constant current Ic is supplied across the electrodes 811 and 812 while the amount of remaining ink in the ink cartridge 800 is a predetermined amount. This voltage value is used as a reference voltage value V0 with which a measured voltage value is compared in order to detect the remaining ink amount. The reference voltage value V0 is measured and stored in the memory 820 at the time of manufacturing the ink cartridge 800.

The remaining ink amount is detected as described below.

First, when the ink cartridge 800 is mounted to the main unit 900 of the ink jet printer, the controller 910 retrieves the reference voltage value V0 from the memory 820 of the ink cartridge 800 and stores the reference voltage value V0 in the memory 920 of the main unit 900.

Subsequently, the controller 910 controls the power supply 930 to supply the constant current Ic across the electrodes 811 and 812. The controller 910 measures a voltage value at point R while the constant current Ic is supplied, and compares the measured voltage value with the reference voltage value V0. The controller 910 determines that the remaining ink amount has reached the predetermined ink amount when the measured voltage value becomes equal to the reference voltage value V0, and issues an alarm to the user as required.

In the above-described embodiment, the remaining ink amount is detected based on changes in the resistance between the electrodes 811 and 812 depending on the remaining ink amount.

However, ink cartridges 800 differ from each other and have variations in the resistance value of each of the electrodes 811 and 812 and the distance between the electrodes 811 and 812, and thus the voltage value at point R measured when the constant current Ic is supplied varies from one ink cartridge to another.

To address this problem, at the time of manufacturing each ink cartridge 800, a voltage value is previously measured when the remaining ink amount is the predetermined amount, and the measured voltage value is stored, as the reference voltage value V0, in the memory 820. Then, at the time of using each ink cartridge 800, the remaining ink amount is determined by comparing a measured voltage value with the reference voltage value V0. This may reduce the influence of individual differences among ink cartridges 800 and enables an accurate measurement of the remaining ink amount.

Input values and output values stored in the memory of the liquid cartridge are not limited to the above-described values. For example, input values other than the input value which, when input to the sensor, causes the output value from the sensor to be saturated, may be stored in the memory, as the input value used for detecting the movable member. Moreover, a table, e.g., Table 1, used for determining the valid use limit of the characteristic information is not necessarily required to be stored in the memory of the manufacturing device and in the memory of the refurbishing device, and may be stored in the memory of the liquid cartridge or in the memory of the liquid ejecting device. The contents of the table are not limited to those of Table 1 and may be changed as appropriate.

Information about the use limit of the characteristic information of the sensor is not limited to the writing date of the characteristic information in the memory of the liquid cartridge, and the valid use period of the characteristic information. For example, information about the use limit of the characteristic information may be the use limit itself of the characteristic information. In this case, the controller of the liquid ejecting device may determine, in Step S3, whether the use limit of the characteristic information is reached, based on the use limit of the characteristic information retrieved in Step S2 and the present date obtained from the built-in timer. When the use limit of the characteristic information is stored in the memory of the liquid cartridge, it is not necessary to store the writing date and the valid use period of the characteristic information or to calculate the elapsed time in Step S3. Further, the memory of the liquid cartridge is not required to store information about the use limit of the characteristic information of the sensor.

The threshold value is not limited to (ICmax+ICmin)/2 and may be (ICmax+ICmin)/3, or any other appropriate value Further, although, in the above-described embodiments, the threshold value is set as the reference output value from the sensor, other values may be set. For example, the output current values ICmax and ICmin retrieved from the memory of the cartridge may be set as the reference output values. In this case, the controller of the printer may determine that the second valve is in the closed position when the output current value from the sensor is within a predetermined range plus or minus the ICmax, and that the second valve is in the open position when the output current value from the sensor is within a predetermined range plus or minus the IC min.

The relation between the input value to the sensor and the output value from the sensor is not limited to a linear function shown in FIG. 9 and may be set or changed as appropriate. In addition, the controller of the liquid ejecting device is not required to determine whether the use limit is reached in Step S3 so long as the controller determines the position of the movable member by the use of the characteristic information retrieved from the memory of the liquid cartridge.

The steps of measuring the output current value and writing data in the memory of the liquid cartridge, e.g., Steps S22-S28 in FIG. 10 and Steps S32-S38 in FIG. 11, in the liquid cartridge manufacturing or refurbishing method may be executed either before or after the ink injecting step, e.g., Step S21 in FIG. 10 and Step S31 in FIG. 11.

The parts assembling step, e.g., Step S20 in FIG. 10 and the ink injecting step, e.g., Step S21 in FIG. 10 and Step S31 in FIG. 11, or the like for manufacturing or refurbishing the liquid cartridge, may be executed by a worker. Moreover, the structure of the liquid cartridge may be changed variously. Specifically, The reservoir 42, the housing 41, the ink outlet tube 43, the valves 50 and 60, the sensor 140, etc. may be changed, in structure, shape, position, etc. New parts may be added, or some of the parts may be eliminated. The number of valves in the liquid cartridges may be one, or three or more.

For example, the first valve 50 in the cartridge 40 in the first embodiment may be eliminated.

The movable member is not limited to the structures illustrated in the above-described embodiments and may be changed in any manner, as long as the movable member is movable relative to the housing of the liquid cartridge. For example, a movable member may be disposed outside the tube 44 of the first embodiment and configured to move in a radial direction of the tube 44 and to press and deform the tube 44 such that the tube 44 is compressed or blocked.

The entrance of the hollow tube may be controlled by the controller as in the first embodiment or by a user manually. In the latter case, the moving mechanism 155 shown in FIG. 12 may optionally be omitted, and a user may enter the hollow tube into the ink outlet path substantially simultaneously with electrical connection between the contacts 142 and 152 and between the electric power input portion 147 and the electric power output portion 157.

The timing for enabling transmission and reception of signals between the liquid cartridge and the liquid ejecting device and the timing for enabling electric power supply from the liquid ejecting device to the liquid cartridge are not limited to those illustrated in the above-described embodiments, and the timing may be set to any suitable timing. The positions of the contacts, the electric power input portion, and the electric power output portion, etc. of the liquid cartridge and the liquid ejecting device may also be changed.

The sensor is not limited to the optical sensor or the magnetic sensor illustrated in the above-described embodiments, and sensors of different types may be used. For example, the sensor may be replaced with a through-beam sensor or a mechanical switch sensor that detects the presence or absence of an object based on whether or not the sensor contacts the object.

The liquid stored in the liquid cartridge is not limited to ink and may be an image quality improving liquid to be applied to a recording medium before recording, a cleaning liquid for cleaning the transport belt or the like. In addition, the head of the liquid ejecting device is not limited to the line type and may be of the serial type. The number of heads of the liquid ejecting device is not limited to four and may be one or more. The liquid ejecting device is not limited to the printer and may be a facsimile, a copy machine or the like.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A liquid cartridge comprising:

a liquid storing portion configured to store liquid therein;

a liquid path configured to be in fluid communication with the liquid storing portion;

a sensor configured to output a particular data corresponding to a particular value indicating that the liquid storing portion is in fluid communication with an exterior of the liquid cartridge, and a further data corresponding to a further value indicating that the liquid storing portion is not in fluid communication with the exterior of the liquid cartridge; and a memory comprising a first data corresponding to a first value and a second data corresponding to a second value, wherein the first value and the second value are defined such that when the particular data and the further data are outputted, one half of a sum of the first value and the second value is between the particular value and the further value.

2. The liquid cartridge of claim 1, wherein the first value and the second value are further defined such that the particular value is less than or equal to the one half of the sum of the first value and the second value.

3. The liquid cartridge of claim 1, wherein the first value and the second value are further defined such that the further value is greater than the one half of the sum of the first value and the second value.

4. The liquid cartridge of claim 1, wherein the sensor is configured to output data corresponding to a continuously changing plurality of values between the further value and the particular value as the cartridge transitions from a state in which the liquid storing portion is not in fluid communication with the exterior of the liquid cartridge to a state in which the liquid storing portion is in fluid communication with the exterior of the liquid cartridge.

5. The liquid cartridge of claim 1, further comprising a sealing member configured to selectively allow the liquid storing portion to be in fluid communication with an exterior of the liquid cartridge.

6. The liquid cartridge of claim 5, wherein the sensor is configured to output the particular data corresponding to the particular value when the sealing member is penetrated.

7. The liquid cartridge of claim 1, wherein when the sensor outputs the data corresponding to the particular value, an object other than the liquid is disposed in the liquid path.

8. The liquid cartridge of claim 1, wherein the sensor is configured to output a data corresponding to values relative to a position of an object other than the liquid in the liquid path.

9. The liquid cartridge of claim 1, wherein the particular value, the further value, the first value and the second value represent voltages.

10. The liquid cartridge of claim 1, wherein the sensor is disposed at a wall at the liquid path.

11. The liquid cartridge of claim 1, further comprising a movable member disposed in the liquid path.

12. The liquid cartridge of claim 11, wherein the sensor is configured to output data corresponding to values relative to a position of the movable member.

13. The liquid cartridge of claim 12, wherein the liquid outlet path is configured to allow liquid to flow therethrough in a liquid flow direction, wherein the movable member is configured to move from a first position to a second position in a direction parallel to the liquid flow direction.

14. The liquid cartridge of claim 11, wherein the movable member is configured to selectively place the liquid storing portion in fluid communication with the exterior of the liquid cartridge via the liquid path.

15. The liquid cartridge of claim 11, wherein the movable member is configured to move between a closed position in the liquid path and an open position in the liquid path, wherein the open position is closer to the liquid storing portion than the closed position, wherein the movable member is in the open position when the liquid storing portion is in fluid communication with the exterior of the cartridge and the movable member is in the closed position when the liquid storing portion is not in fluid communication with the exterior of the cartridge.

16. The liquid cartridge of claim 15, wherein when the movable member is in the open position, the sensor is configured to output the particular data corresponding to the particular value.

17. The liquid cartridge of claim 15, wherein when the movable member moves from the closed position to the open position, the sensor is configured to output a transition data corresponding to a transition value.

18. The liquid cartridge of claim 11, wherein as the liquid cartridge transitions from a state in which the liquid storing portion is not in fluid communication with the exterior of the cartridge to a state in which the liquid storing portion is in fluid communication with an exterior of the liquid cartridge, the movable member moves from the closed position to the open position.

19. The liquid cartridge of claim 18, wherein when the movable member is in the open position, the sensor is configured to output the particular data corresponding to the particular value.

20. The liquid cartridge of claim 1, wherein the sensor is configured to output data corresponding to values relative to a position of a movable member disposed outside of the liquid path.

21. The liquid cartridge of claim 1, wherein the sensor comprises a magnetic sensor configured to output a signal corresponding to a magnetic flux density.

22. A liquid ejecting device comprising:

a liquid cartridge; and a main body, wherein the liquid cartridge is removably attachable to the main body, the liquid cartridge comprising:

a liquid storing portion configured to store liquid therein;

a liquid path configured to be in fluid communication with the liquid storing portion;

a sensor configured to output a particular data corresponding to a particular value indicating that the liquid storing portion is in fluid communication with an exterior of the liquid cartridge, and a further data corresponding to a further value indicating that the liquid storing portion is not in fluid communication with the exterior of the liquid cartridge; and a memory comprising a first data corresponding to a first value and a second data corresponding to a second value, wherein the first value and the second value are defined such that when the particular data and the further data are outputted, one half of a sum of the first value and the second value is between the particular value and the further value, the main body comprising:

a mounting portion to which the liquid cartridge is selectively receivable, an insertion member configured to be removably insertable into the liquid cartridge; and a controller configured to retrieve the first data corresponding to the first value, and second data corresponding to the second value, wherein when the insertion member is inserted into the liquid cartridge, the controller is configured to retrieve the data corresponding to the particular value and to determine whether the particular value is less than or equal to one half of a sum of the first value and second value.

23. A method of manufacturing a liquid cartridge having a liquid path attached to a liquid storing portion, the method comprising:

storing a first data corresponding to a first value in a memory;

storing a second data corresponding to a second value in the memory;

disposing a sensor near the liquid path, wherein the sensor is configured to output a particular data corresponding to a particular value indicating that the liquid storing portion is in fluid communication with an exterior of the liquid cartridge, and a further data corresponding to a further value indicating that the liquid storing portion is not in fluid communication with the exterior of the liquid cartridge, wherein one half of a sum of the first value and the second value is between the particular value and the further value;

filling the liquid storing portion with liquid; and plugging the liquid path by disposing a plug in the liquid path.

24. A method of refurbishing a liquid cartridge having a liquid path attached to a liquid storing portion, a sensor disposed near the liquid path, and a memory comprising a first data corresponding to a first value and a second data corresponding to a second value, the method comprising:

preparing the liquid cartridge for refilling;

storing a new first data corresponding to a new first value in the memory to replace the first data;

storing a new second data corresponding to a new second value in the memory to replace the second data, wherein the sensor is configured to output a particular data corresponding to a particular value indicating that the liquid storing portion is in fluid communication with an exterior of the liquid cartridge, and a further data corresponding to a further value indicating that the liquid storing portion is not in fluid communication with the exterior of the liquid cartridge, wherein one half of a sum of the new first value and the new second value is between the particular value and the further value;

refilling the liquid storing portion with liquid; and plugging the liquid path by disposing a plug in the liquid path.

* * * * *